US009056705B2

(12) United States Patent
Yuyama et al.

(10) Patent No.: US 9,056,705 B2
(45) Date of Patent: Jun. 16, 2015

(54) MEDICAMENT DISPENSING MACHINE AND MEDICAMENT DISPENSING METHOD

(75) Inventors: Shoji Yuyama, Osaka (JP); Masahiko Kasuya, Osaka (JP)

(73) Assignee: YUYAMA MFG. CO., LTD., Toyonaka-Shi (JP)

( * ) Notice: Subject to any disclaimer, the term of this patent is extended or adjusted under 35 U.S.C. 154(b) by 269 days.

(21) Appl. No.: 13/806,137

(22) PCT Filed: Jun. 28, 2011

(86) PCT No.: PCT/JP2011/064721

§ 371 (c)(1),
(2), (4) Date: Mar. 10, 2013

(87) PCT Pub. No.: WO2012/002342

PCT Pub. Date: Jan. 5, 2012

(65) Prior Publication Data

US 2013/0153594 A1 Jun. 20, 2013

(30) Foreign Application Priority Data

Jun. 30, 2010 (JP) ..... 2010-149071

(51) Int. Cl.

| | |
|---|---|
| ***B65D 83/00*** | (2006.01) |
| ***B65D 83/04*** | (2006.01) |
| ***A61J 1/00*** | (2006.01) |
| ***G07F 11/42*** | (2006.01) |
| ***G07F 17/00*** | (2006.01) |

(52) U.S. Cl.

CPC ..... *B65D 83/00* (2013.01); *G07F 11/42* (2013.01); *G07F 17/0092* (2013.01); *B65D 2583/00* (2013.01)

(58) Field of Classification Search

USPC ..... 83/13, 14, 72, 78, 42, 39, 56, 256, 614, 83/948, 35, 74, 368, 371, 404.1, 419; 221/151, 277, 1, 30, 31; 53/484

See application file for complete search history.

(56) References Cited

U.S. PATENT DOCUMENTS 4,546,901 A * 10/1985 Buttarazzi ..... 221/10
2003/0131702 A1* 7/2003 Sauer et al. ..... 83/23

(Continued)

FOREIGN PATENT DOCUMENTS

JP 04-272758 A 9/1992
JP 2818759 B2 10/1998

(Continued)

OTHER PUBLICATIONS

Extended European Search Report in EP Application No. 11800806.9, Issued on Jan. 8, 2015 EPO.

*Primary Examiner* — Ghassem Alie

(74) *Attorney, Agent, or Firm* — Masuvalley and Partners

(57) ABSTRACT

A medicine dispensing device for accommodating large quantity of blister packages is described. The medicine dispensing device allows for a fast and proper dispensing of blister packages, even when dispensing fractions. The device includes a storage container having an outlet and an opening/closing door provided with a holding part, which moves to a holding position for holding the blister package being discharged from the outlet and a releasing position to release the blister package. The opening/closing door further includes a biasing part for biasing the holding part to the holding position and a reference surface for carrying out the positioning of the blister package when the holding part is moved to the releasing position. A gripping member is provided for gripping the blister package and transporting it toward a cutting member and for returning the remainder, after the blister package being cut, into the holding part of the opening/closing door.

6 Claims, 19 Drawing Sheets

(56) References Cited

U.S. PATENT DOCUMENTS

| | | | | |
|---|---|---|---|---|
| 2008/0061071 | A1 | 3/2008 | Omura et al. | |
| 2008/0236352 | A1 * | 10/2008 | Kim | 83/84 |

FOREIGN PATENT DOCUMENTS

| | | | |
|---|---|---|---|
| JP | 2006-109859 | A | 4/2006 |
| WO | 2010/032479 | A | 3/2010 |

* cited by examiner

MEDICAMENT DISPENSING MACHINE AND MEDICAMENT DISPENSING METHOD

This application is a National Stage application under 35 U.S.C. §371 of International Application Serial No. PCT/JP2011/064721, filed on Jun. 28, 2011, and claims the priority benefit under 35 U.S.C. §119 of Japanese Patent Application No. 2010-149071, filed on Jun. 30, 2010, which are hereby expressly incorporated by reference in their entirety for all purposes.

TECHNICAL FIELD

The present invention relates to a medicine dispensing device and a medicine dispensing method.

BACKGROUND ART

Conventionally, there is a medicine dispensing device for dispensing blister packages having a configuration in which a blister package is conveyed with the help of a grip unit and cut by a cutter mechanism to enable retrieval of the required quantity of the package sheet (see Patent document 1, for example).

As another medicine dispensing device for dispensing blister packages, there is one having a configuration that enables retrieval of a blister package loaded inside a medicine cassette by sucking it with a suction member (see Patent document 2, for example).

However, in the medicine dispensing device disclosed in Patent Document 1, a grip unit is used for retrieving not only a fraction of the blister package but also one full blister package, and therefore, there is a problem of poor retrieving efficiency. Further, since the blister packages are stacked vertically, the space occupied in the height direction increases, and there is a problem that the quantity and type that can be accommodated is limited.

In the medicine dispensing device disclosed in Patent Document 2, it is not possible to dispense fraction of a blister package.

PRIOR ART DOCUMENTS

Patent Documents

Patent document 1: U.S. Pat. No. 2,818,759

Patent document 2: Japanese Patent Application Publication 2006-109859

SUMMARY OF THE INVENTION

Problem to be Solved by the Invention

Therefore, the present invention intends to provide a medicine dispensing device capable of accommodating a larger quantity of blister packages and proper dispensing even in a case of a fraction blister package by always positioning it in a predetermined position while achieving a faster dispensing.

Means to Solve the Problem

The present invention, as a means to solve the problems mentioned above, provides a medicine dispensing device including:

a device body;

a storage container that accommodates in a stacked state a plurality of blister packages in which medicines are separately packed, the storage container being attached to the device body such that a direction in which the blister packages are stacked is horizontal or approximately horizontal direction;

a dispensing member movably provided at the device body, the dispensing member moving up to the storage container and dispensing the accommodated blister package;

a gripping member that grips and transports the blister package dispensed by the dispensing member; and a cutting member that cuts a fraction out of the blister package that is gripped and transported by the gripping member, and wherein the storage container includes:

an outlet formed in a bottom surface at one end side for taking out the blister package;

a biasing member that biases the accommodated blister package towards the outlet side; and an opening/closing door that is disposed at an outer end surface at the outlet side, wherein the opening/closing door includes: a guide reception part that guides a blister package that is dispensed from the outlet of the storage container; a holding part capable of moving between a holding position for holding the blister package with the guide reception part and a releasing position for releasing the blister package; and a biasing part that biases the holding part towards the holding position, wherein the guide reception part has a reference surface with which a lower edge part of the blister package can come into contact so as to position the blister package when the holding part is moved to the release position, and wherein the gripping member has an action part that can move the holding part from the holding position to the releasing position against a biasing force of the biasing part.

With this configuration, because the action part of the gripping member moves the holding part that holds a blister package, and temporarily moves it from holding position to release position, a fraction of a blister package can be always positioned in the same position with respect to the opening/closing door, that is, the side edge of the blister package can be positioned based on the reference surface. Therefore, a blister package can be always gripped in the same position by the gripping member. This makes it possible to smoothly cut a subsequent fraction.

It is preferable that the gripping member include a pair of holding pieces that is openable and closable, and a sensor that is capable of detecting the blister package.

With this configuration, the gripping position of a blister package by a holding piece can be detected by the sensor, and it is possible to ensure that the blister package is reliably gripped.

It is preferable that the opening/closing door can be positioned at a normal dispensing position and at a fraction dispensing position, the normal dispensing position allowing a dispensing operation of the blister package by the dispensing member, and the fraction dispensing position allowing a dispensing operation of the blister package by the dispensing member and enabling the holding part to hold the dispensed blister package, and wherein the gripping member can grip at the fraction dispensing position the blister package that is held by the holding part of the opening/closing door and transport the blister package to the cutting member, and the remaining blister package after the fraction is cut by the cutting member is transported and held by the holding part of the opening/closing door.

With this configuration, when dispensing one entire blister package, a blister package can be pushed down and dispensed by the dispensing member in the state wherein the opening/closing door is positioned at the normal dispensing position. Therefore, a speedy dispensing operation becomes possible. Further, when dispensing a fraction of the blister package, by positioning the opening/closing door at the fraction dispensing position, by using the dispensing member to only push down a blister package in the storage container vertically, this blister package can be held by the holding part of the opening/closing door that is biased by the biasing part.

It is preferable to include a control member for positioning the lower edge part of the blister package by its own weight with respect to the reference surface by driving and controlling the gripping member and rotating the holding part once to the releasing position by the action part when holding the blister package at the opening/closing door.

With this configuration, the holding part can be temporarily rotated to the release position after holding a blister package by the holding part of the opening/closing door, and therefore, due to its own weight of the blister package, it can be positioned with its lower edge contacting the reference surface of the opening/closing door.

It is preferable that the holding part of the opening/closing door includes a magnetic material, and wherein the action part of the gripping member includes a magnet that can attract the holding part.

It is preferable that the gripping member includes a magnet at one holding piece, and when the holding piece is positioned at the releasing position, the holding part of the opening/closing door is attracted and a holding state of the blister package is released.

With this configuration, immediately before a blister package that is held in the holding part of the opening/closing door is gripped by the gripping member, this blister package can be positioned with respect to the reference surface of the opening/closing door.

Further, in the present invention, as a means to solve the problems mentioned above, a medicine dispensing method is performed by a medicine dispensing device, the medicine dispensing device including:

a device body, a storage container that accommodates in a stacked state a plurality of blister packages in which medicines are separately packed, the storage container being attached to the device body such that a direction in which the blister packages are stacked is horizontal or approximately horizontal direction;

a dispensing member movably provided at the device body, the dispensing member moving up to the storage container and dispensing the accommodated blister package;

a gripping member that grips and transports the blister package dispensed by the dispensing member; and a cutting member that cuts a fraction out of the blister package that is gripped and transported by the gripping member, and wherein the medicine dispensing method includes: positioning a lower edge part of the blister package by its own weight with respect to a reference surface by driving and controlling the gripping member and rotating a holding part once to the releasing position by an action part when holding the blister package at the opening/closing door.

Effect of the Invention

According to the present invention, by biasing the holding part by a biasing part to hold it at a holding position, a blister package is held at the opening/closing door, and by moving the holding part to the release position by the action part of the gripping member, the blister package is contacted with the reference surface of the opening/closing door and positioned. Accordingly, a blister package can always be positioned based on a reference surface, and the subsequent gripping or transport of the blister package by the gripping member can be smoothly performed.

BEST MODE FOR CARRYING OUT THE INVENTION

Embodiments according to the present invention will be described below with reference to the accompanying drawings. In the following description, terms indicating specific direction or position (for example, terms includes 'up', 'down', 'side', and 'end') are used if necessary, but they are for facilitating easy understanding of the invention with reference to the drawings, and the technological scope of the present invention is not limited by the meanings of those terms. Also, the following description is merely illustrative in nature, and is not intended to limit the present invention, its application material or its use.

1. Configuration

Figure 1:
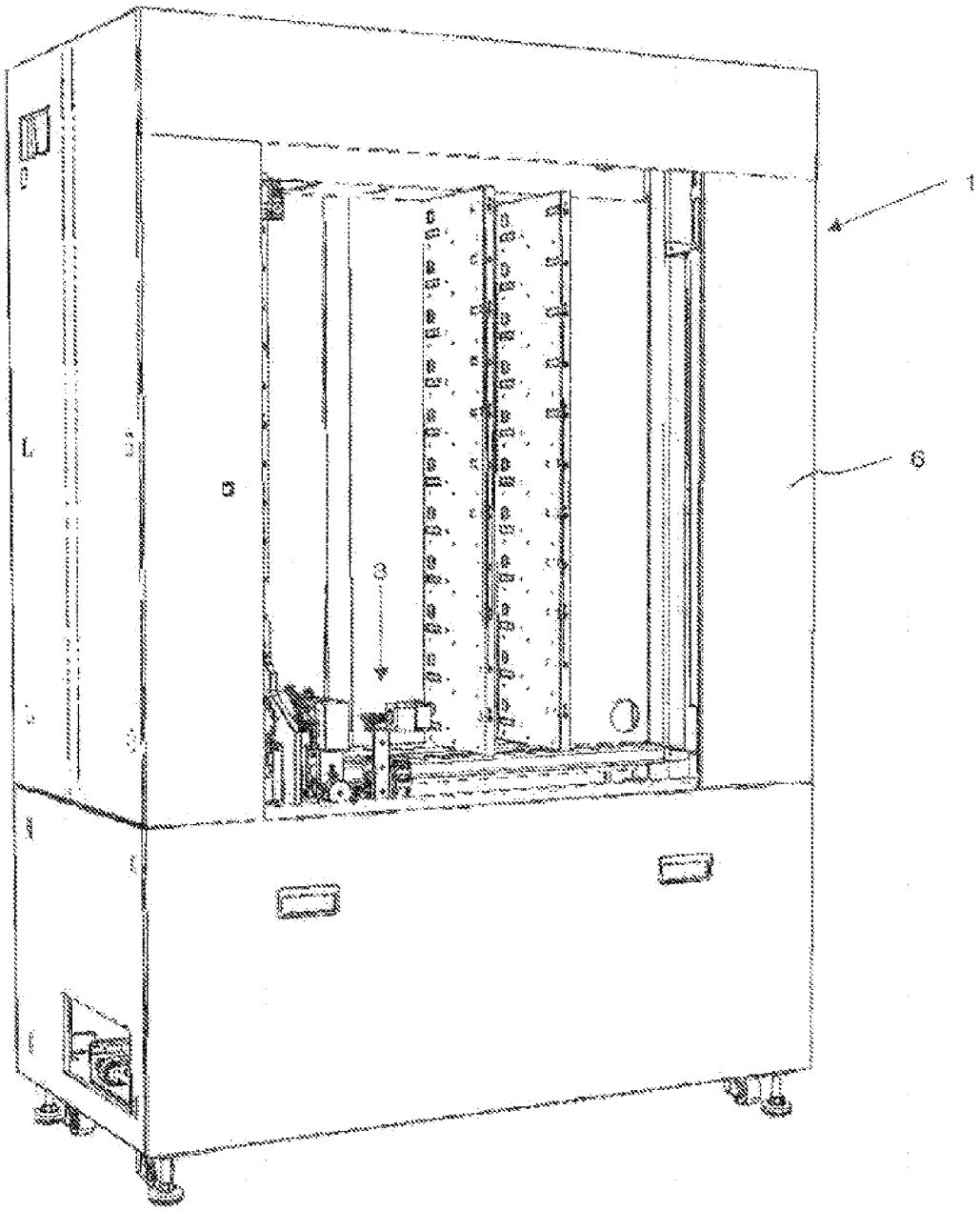
FIG. 1 is a perspective view showing the exterior of a medicine dispensing device according to the present embodiment.
Figure 2:
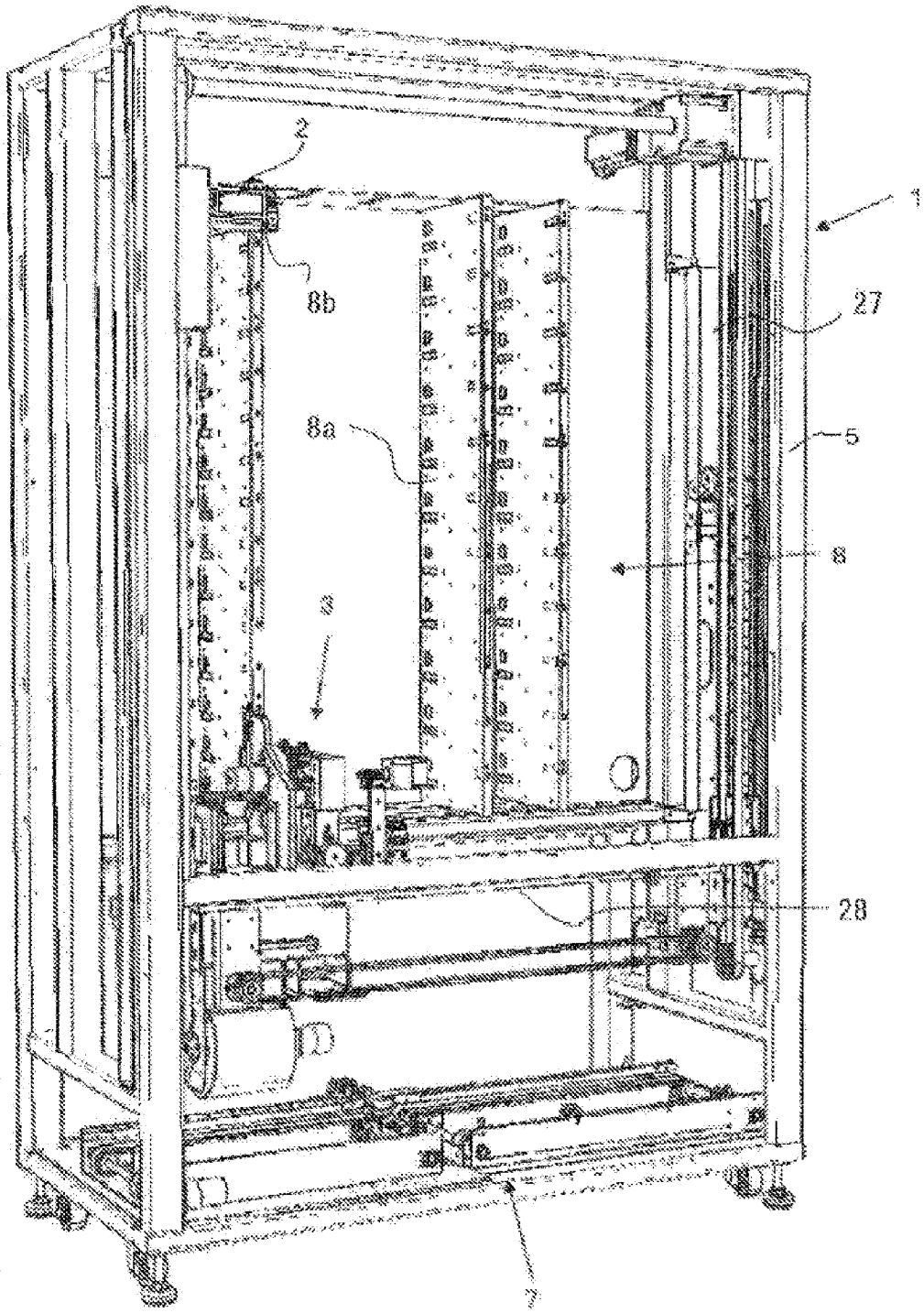
FIG. 2 is a perspective view showing a state in which the exterior panel has been removed from FIG. 1.
Figure 15:
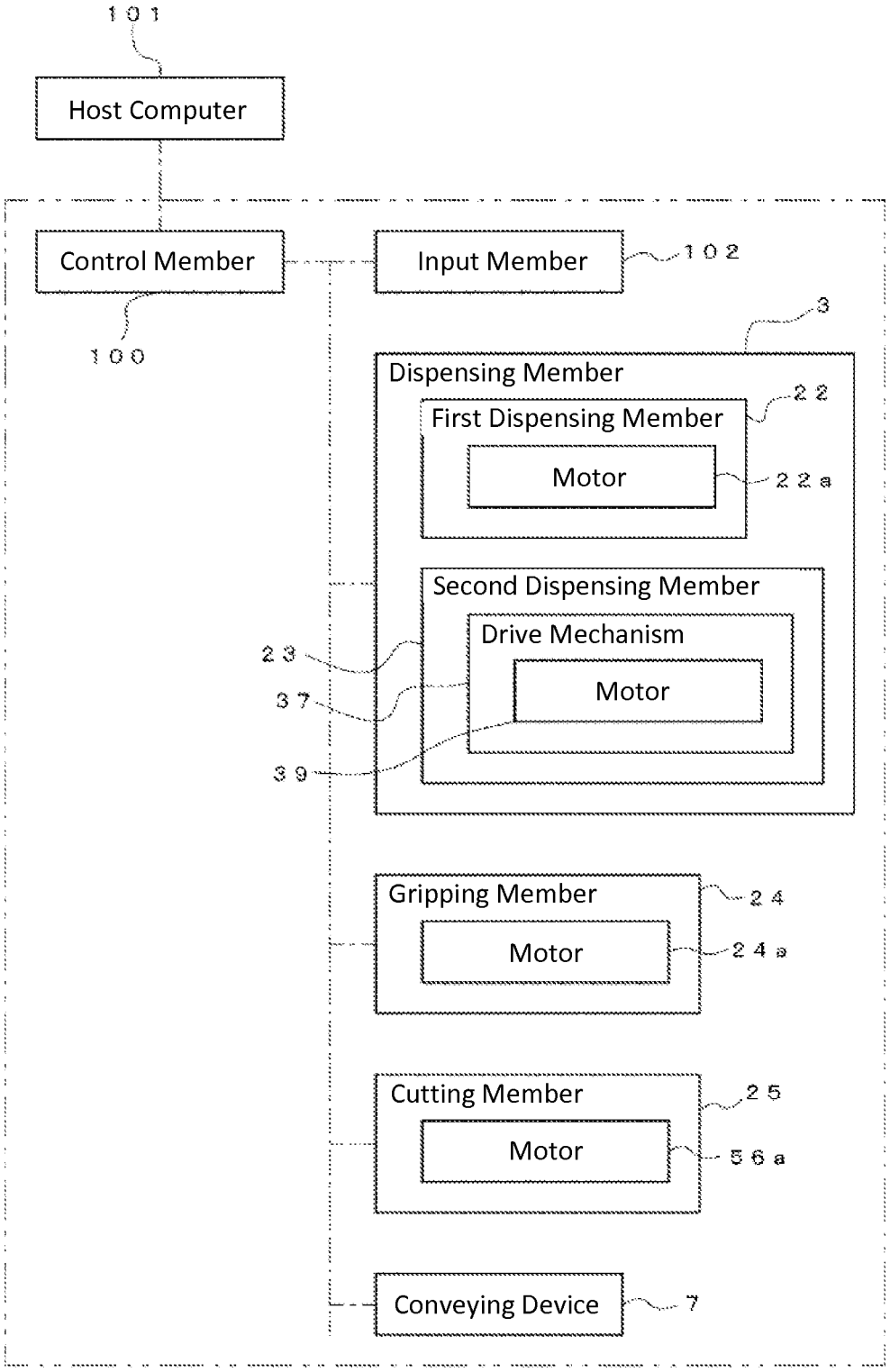
FIG. 15 is a block diagram of a medicine dispensing device according to the present embodiment.

FIG. 1 is a schematic perspective view of a medicine dispensing device according to the present embodiment, and FIG. 2 is a diagram showing a state wherein the exterior panel 6 is removed. This medicine dispensing device is configured such that a plurality of cassettes 2, which are storage containers, are tightly mounted in a grid pattern in the device body 1, and the blister packages 4 in which a plurality of medicine has been packaged (see FIG. 12) are dispensed sequentially from each cassette 2 from a dispensing member 3. Then, the dispensing process of a series of blister packages 4 is executed in a control member 100 (see FIG. 15) based on the prescription data inputted from a host computer or the like, which is not shown.

1-1. Device Body 1

The device body 1, as shown in FIG. 1 and FIG. 2, is formed in a substantially rectangular parallelepiped shape by attaching an exterior panel 6 to the periphery of the frame 5, and a conveying device 7 for conveying a tray, which is not illustrated, is provided in the lower region, and the upper region of the rear half portion serves as a cassette loading portion 8. Here, although a roller conveyor is used as the conveying device 7, it is possible to use various transport means such as belt conveyor, pusher etc. In the cassette mounting part 8, mounting members 8*b* are provided on the opposite faces 8*a* of the support panels disposed at a predetermined distance in left and right directions, and it has a configuration wherein cassettes 2 can be inserted and mounted into the mounting members 8*b*.

1-2. Cassette 2

A cassette 2, as shown in FIG. 3 through FIG. 6, is comprised of a substantially rectangular parallelepiped shaped cassette body 9 that is open at top, and an opening/closing door 10 disposed on the front surface of the cassette body 9.

Figure 3:
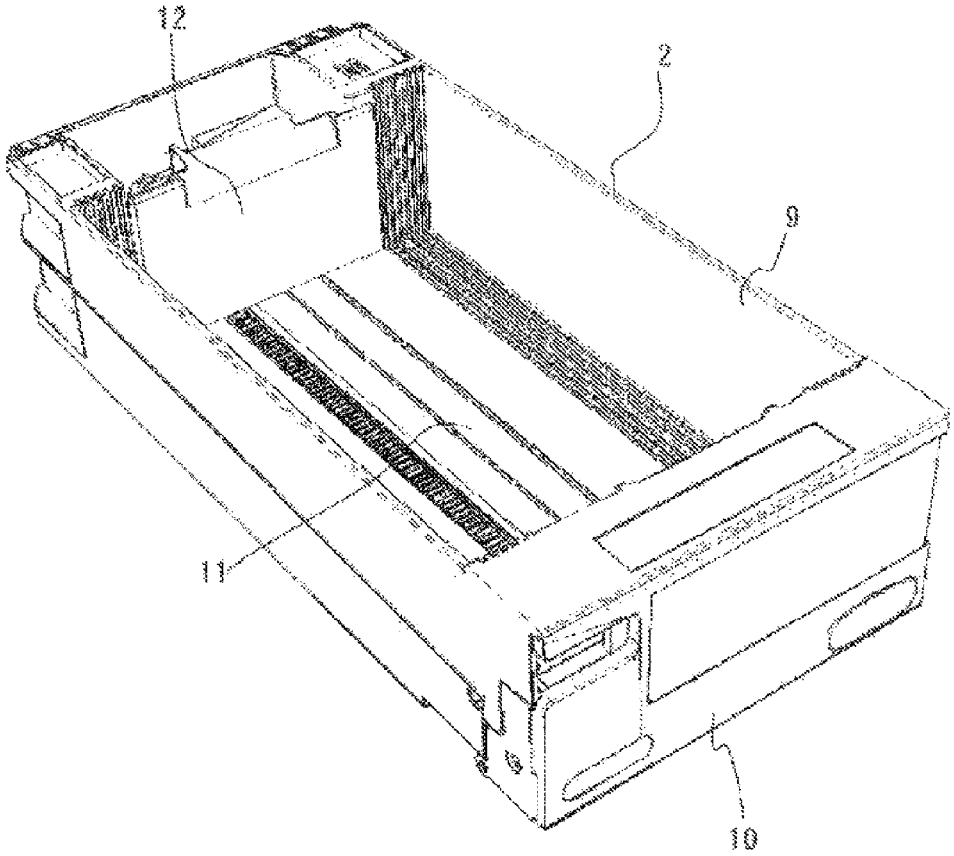
FIG. 3 is a perspective view of a cassette that is mounted in the cassette mounting part of FIG. 2.

As shown in FIG. 3, a guide groove 11 is formed in the bottom surface of the cassette body 9. In the cassette body 9, a pushing member 12 is disposed so as to be able to reciprocate along the guide groove 11. Further, the pushing member 12 can bias blister packages 4 loaded in the cassette body 9 towards the opening/closing door 10 with a constant load by using the constant weight spring (conston), which is not shown, regardless of the change of position.

Figure 5:
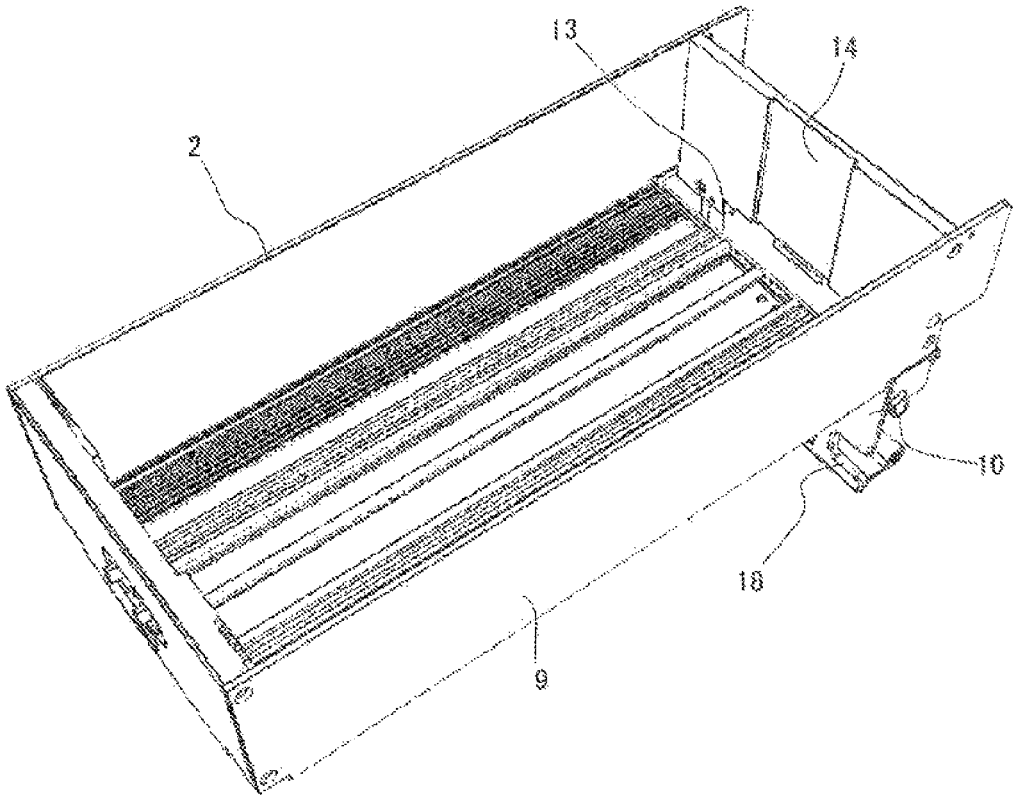
FIG. 5 is a perspective view showing FIG. 4 viewed from a different direction.

Further, in the front end portion of the cassette body 9, as shown in FIG. 5, an outlet 13 is formed in the bottom surface to facilitate retrieval of a top blister package 4. The outlet 13 is partially closed by a closure piece (not shown) provided rotatably in the center of the front end portion on bottom surface so that the falling off of the top blister package 4 is prevented. The closure piece is biased in the closing direction by a spring (not shown).

As shown in FIG. 5, in the front plate 9*a* of the cassette body 9, a recess 14 is formed extending vertically in the middle section of the inside. This recess 14, as explained later, is an escape to facilitate moving of the pressing part 30 when retrieving the top blister package 4.

Figure 12:
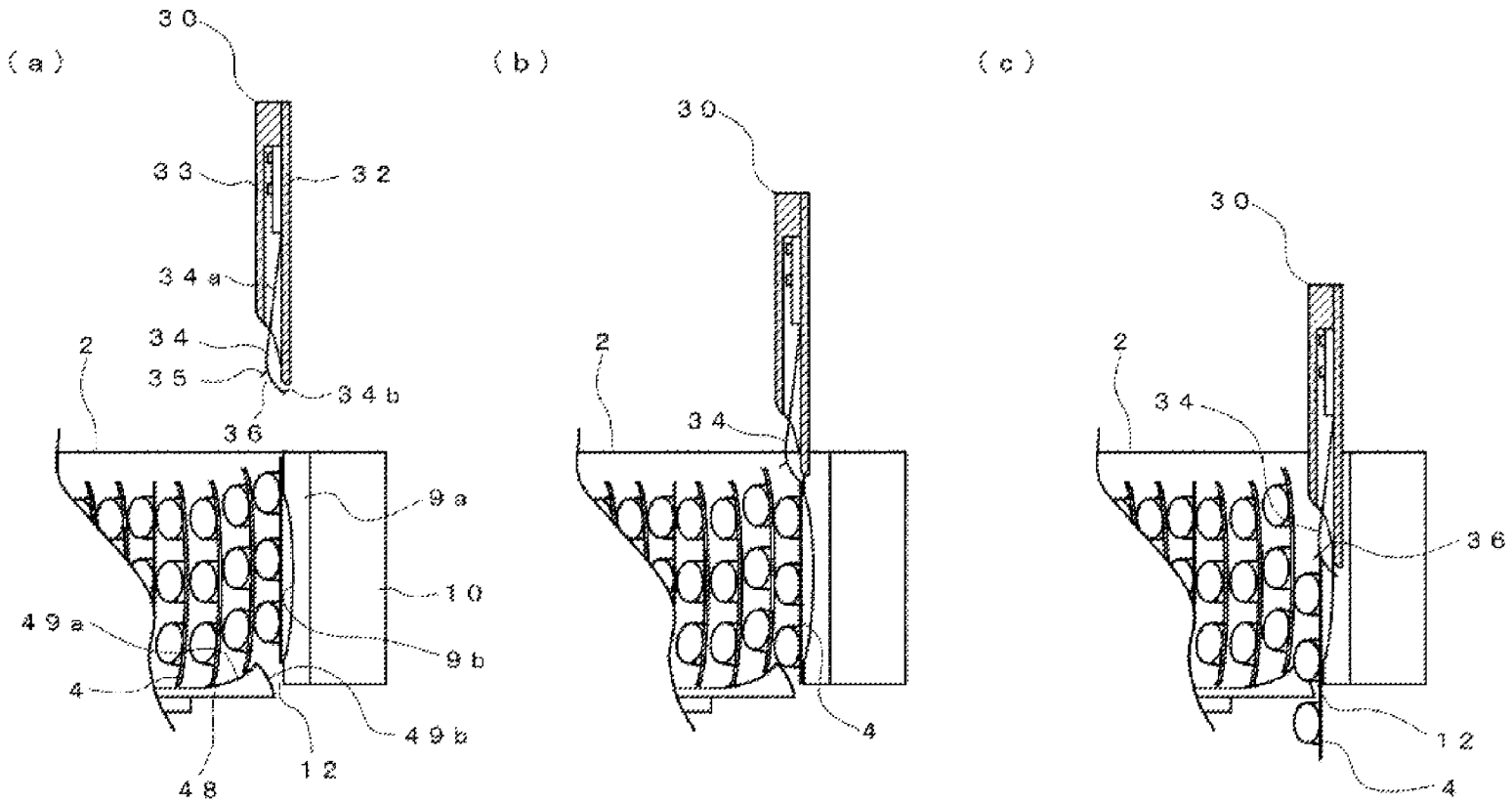
FIG. 12 is a schematic side view showing a dispensing operation of dispensing a straight blister package for a fraction from the cassette by the pressing part of FIG. 11.

In the front plate 9*a* of the cassette body 9, as shown in FIG. 12 (*a*), on both sides of the inner side (on both sides of the recess 14 as shown in FIG. 5), it is preferable to provide a curved surface 9*b* that is depressed towards the front side most in the middle part of the vertical direction. With this configuration, even if a blister package 4 housed in the cassette body 9 is curved, its contact position with front plate 9*a* can be oriented towards front side by the curved surface 9*b*. In other words, even if a blister package 4 is curved, it is possible to fix the position of its upper edge so that it is not positioned largely away from the front plate 9*a*. Therefore, even in case of a curved blister package 4, it is possible to smoothly push it down by the pressing part 30 of the dispensing member 3, which is described later.

At the bottom of the cassette body 9, it is preferable to provide a guide plate 48 on both sides in the front part (two places in the width direction) as shown in FIG. 12 (*a*). The guide plate 48 is provided with a first curved surface 49*a* that gradually projects upwards towards the front plate 9*a*. From the first curved part 49*a* to the tip section, a second curved surface 49*b* (guiding surface) is formed as a protrusion. The second curved surface 49*b* guides a blister package 4 sliding through that place to the outlet 13, and in addition, in case this blister package 4 is curved in the transverse direction, it will exert a force in a direction so as to straighten it. It is possible to adjust the position of the guide plate 48 in the width direction (in FIG. 12(*a*), direction perpendicular to space). With this, the guide plate 48 can be positioned between multiple pockets that contain the medicine of the blister package 4. Moreover, the guide plate 48 is attached so as to provide only a small gap between the guide plate 48 and the front plate 9*a* such that only one sheet part (a flat area provided with a cover film, as described later) of a blister package 4 can pass through. With this, the lower edge of a blister package 4 positioned near the outlet 13 can be reliably supported, and dispensing of overlapped blister packages 4, or occurrence of clogging can be prevented. In addition, the above-mentioned front closure piece or the like can be eliminated.

Figure 4:
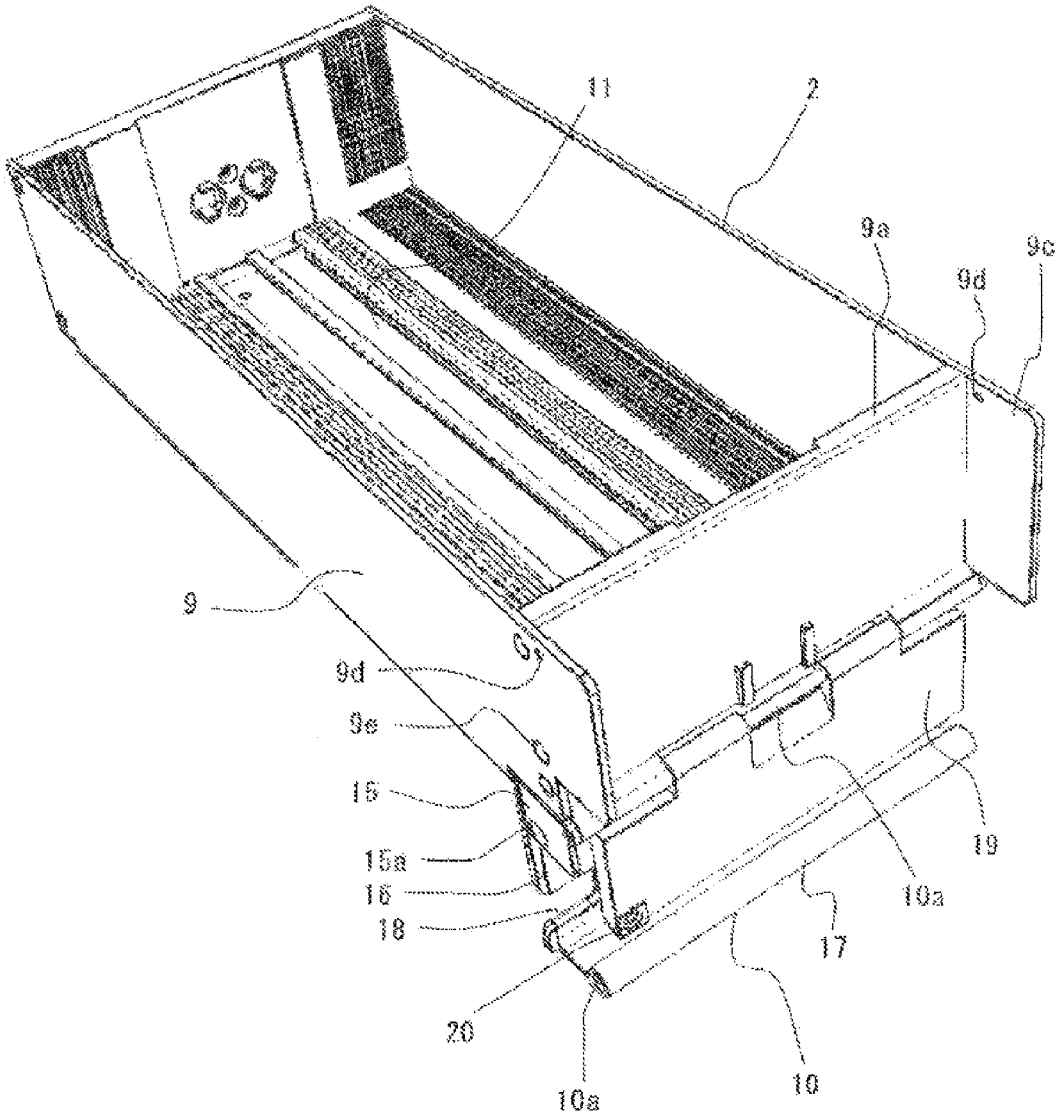
FIG. 4 is a perspective view showing a state in which the opening/closing door is rotated to fraction dispensing position from FIG. 3.

As shown in FIG. 4, on both sides of the cassette body 9, a guide surface part 9*c* projecting further forward from the front surface is provided. In each guide surface part 9*c*, a lock hole 9*d* is respectively formed in opposite positions, and a locking projection (not shown) attached to the recessed part 10*a* of the opening/closing door 10 can be respectively engaged/disengaged. Thereupon, when the opening/closing door 10 is rotated to closed position, the locking projection (not shown) locks with the lock hole 9*d*, and the opening/closing door 10 can be positioned at the closed position. Also, a guide hole 9*e* is formed in one of the guide surface parts 9*c*, and the guide pin 46 of the drive mechanism 37, which is described later, can be engaged/disengaged.

In a cassette body 9, as shown in FIG. 12(*a*), a plurality of blister packages 4 (PTP (Press Through Package) sheets) are stacked and arranged laterally. A blister package 4, although the detail is not illustrated, consists of a plurality of pockets for containing medicine, and has a cover film attached so as to cover the pockets. Regarding the stacking direction of blister packages 4, the cover film side will orient toward the front side of the cassette body 9.

Figure 6:
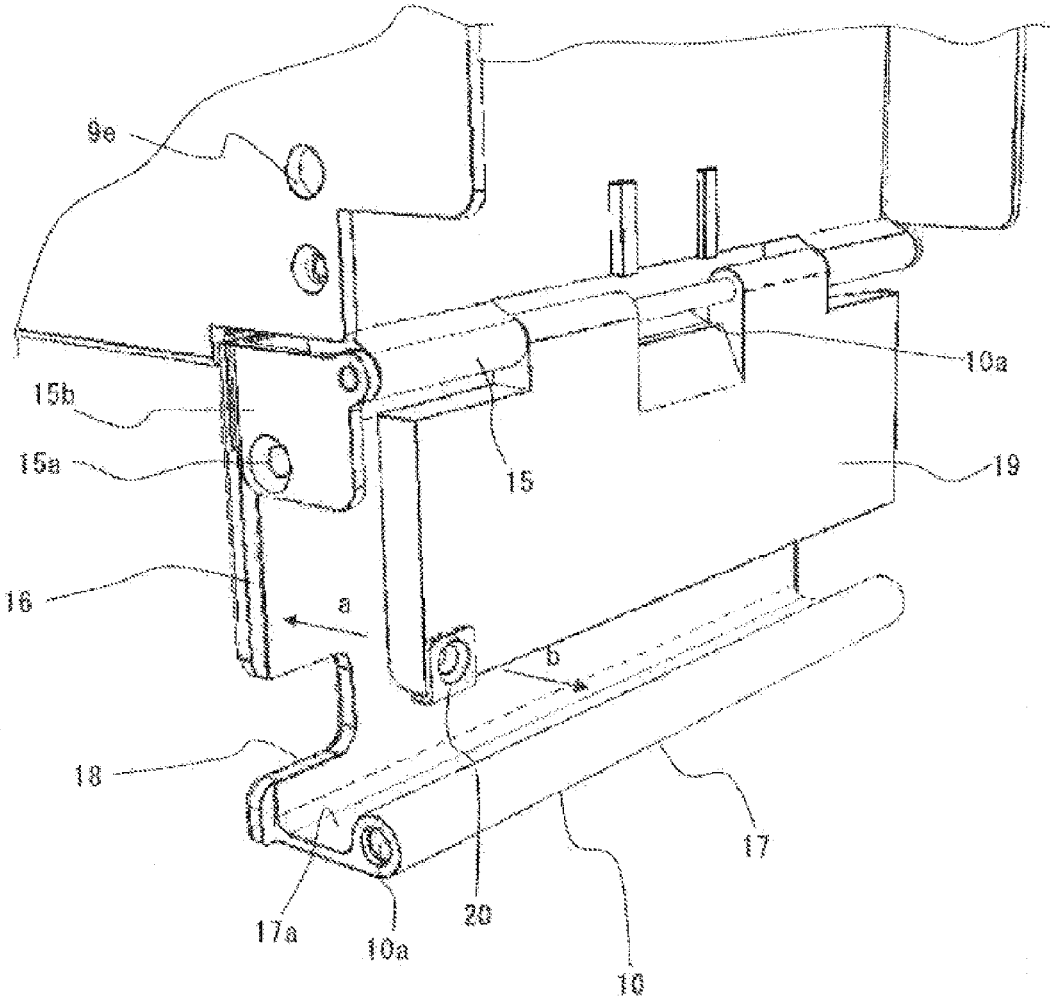
FIG. 6 is an enlarged perspective view of the opening/closing door of FIG. 4.

The opening/closing door 10, as shown in FIG. 6, is attached at the front side lower end of the cassette body 9 so as to be rotatable around a spindle 10*a*. The opening/closing door 10 is comprised of a bearing part 15 attached rotatably to the spindle 10*a*, a front surface portion 16 extending from this bearing part 15, and a guide reception part 17 folded in cross-sectional U shape from the front edge of this front surface portion 16.

The bearing part 15, at its one end, is integrated with an end surface 15*b* provided with an operation hole 15*a* in which the rotating pin 43 of a dispensing member 3, which is described later, can engage or disengage. The front surface portion 16 is a flat plate, and in the middle of its one side is provided with a notch portion 18. Using this notch portion 18, a fraction of a blister package 4 can be gripped by a gripping member 24, which is described later. The guide reception part 17 has a reference surface 17*a* wherein the side edge (lower edge) of a fraction (remainder) of the blister package 4 comes in contact and positioned. The tip edge of the guide reception part 17 folded in U-shape is formed in a circular cross-sectional shape, and a recess 10*a* is formed at the both ends, and the recesses are provided with a locking projection (not shown) that locks with the lock hole 9*b* of the guide surface 9*a* when the opening/closing door 10 is positioned at the closed position.

It is possible to position the opening/closing door 10 at the normal dispensing position (FIG. 3) wherein it is rotated to the front end of the cassette body 9 by engaging the rotating pin 43 of the dispensing member 3 with the operation hole 15*a*, and at the fraction dispensing position (FIG. 4) wherein this closed position is rotated by 180 degree. By making the lower edge of the blister package 4 contact the reference surface 17*a* when the opening/closing door 10 is rotated to fraction dispensing position, the blister package 4 can be positioned with respect to the reference surface 17*a*.

The holding piece 19 is rotatably attached to the spindle 10*a*. The holding piece 19 is biased towards the front surface portion 16 (in FIG. 6, shown in the direction of the arrow a) by a coil spring (not shown) attached to the spindle 10*a*. With this, it is possible to hold a blister package 4 by sandwiching it between the front surface portion 16 and the holding piece 19. An attracted part 20 made of a magnetic material is integrated at lower end of an edge of the holding piece 19. Thereupon, when the attracted part 20 is attracted by a magnet 52, which is described later (see FIG. 7), the holding piece 19 is rotated in the direction of the arrow b in FIG. 6 so as to become almost parallel to the front surface portion 16, and the holding state of the blister package 4 is released. Here, the blister package 4, by contacting its lower edge with the reference surface 17*a*, will be positioned in the vertical direction.

In addition, although not shown, a magnetic part and a light emitting part are provided in the front surface of the cassette. When pulling out a cassette 2 from the cassette mounting part 8, this magnetic part is attracted by an electromagnetic part (not shown) provided on a support plate 21, which is described later. Light from the LED (not shown) provided in the device body 1 side is emitted to the light emitting part. The light emitting part is illuminated by LED when notifying a missing part or abnormality of the medicine, for example. With this, the electrical accessories or wiring in the cassette 2 becomes unnecessary, and the configuration can be simplified so that manufacturing at a lower cost is possible.

1-3. Dispensing Member 3

Figure 8:
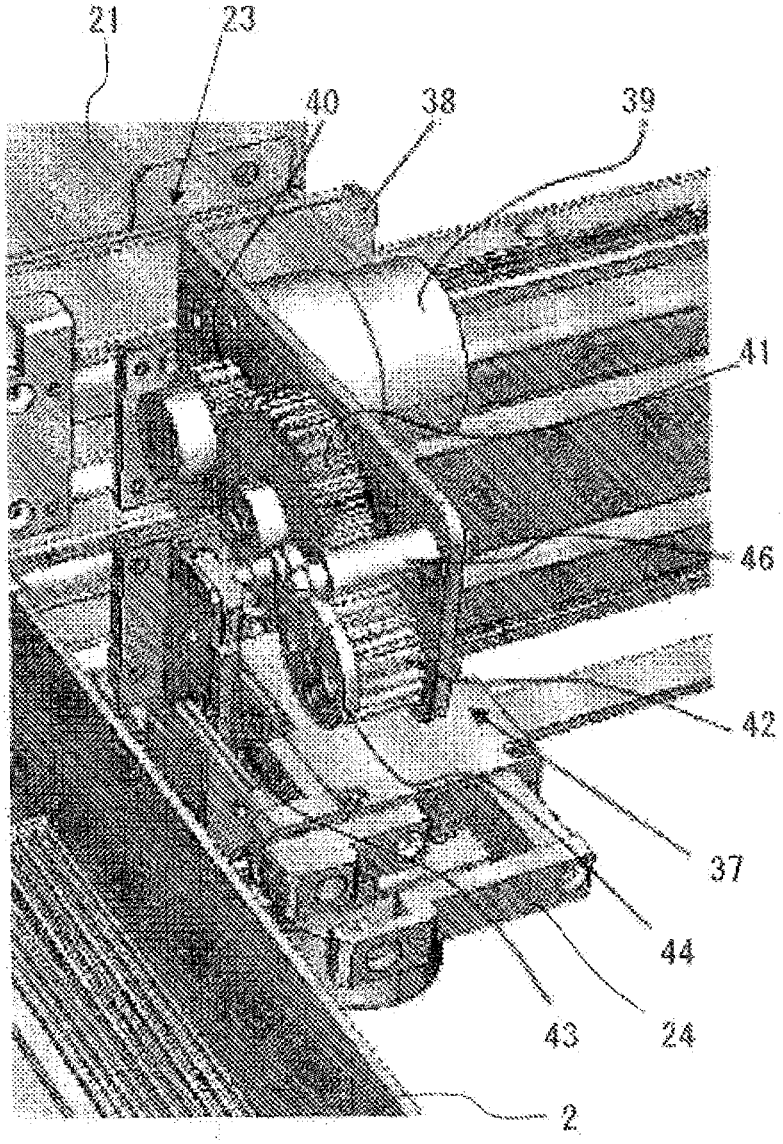
FIG. 8 is a perspective view of a drive mechanism to open/close the opening/closing door of FIG. 4.
Figure 9:
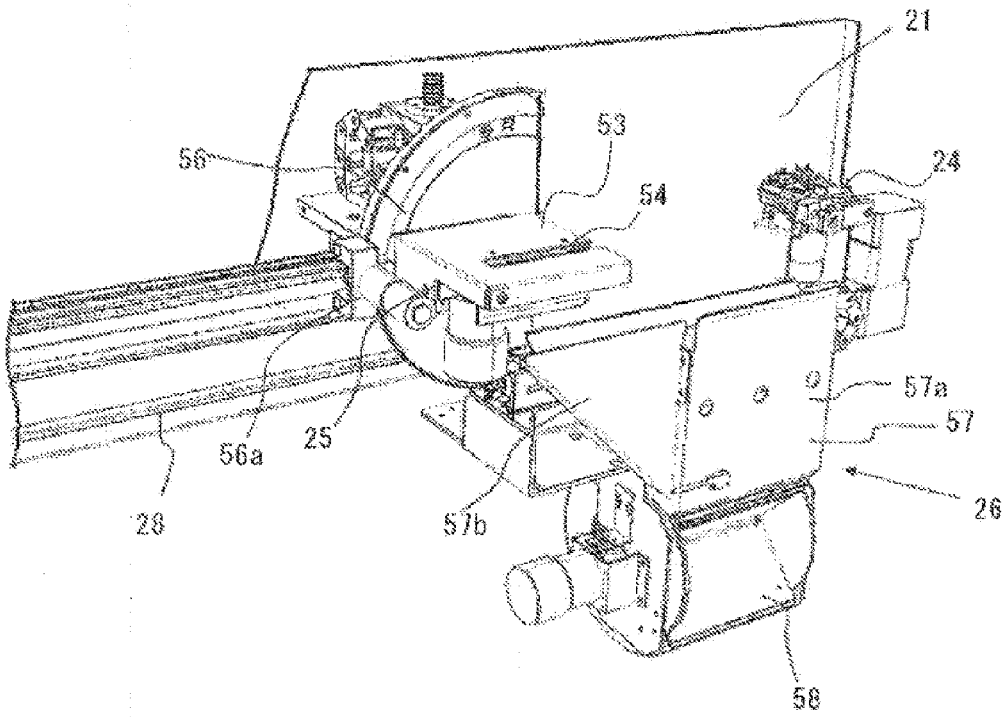
FIG. 9 is a perspective view showing, among the dispensing members of FIG. 1, the gripping member, cutting member and recovery member attached to support plate.
Figure 10:
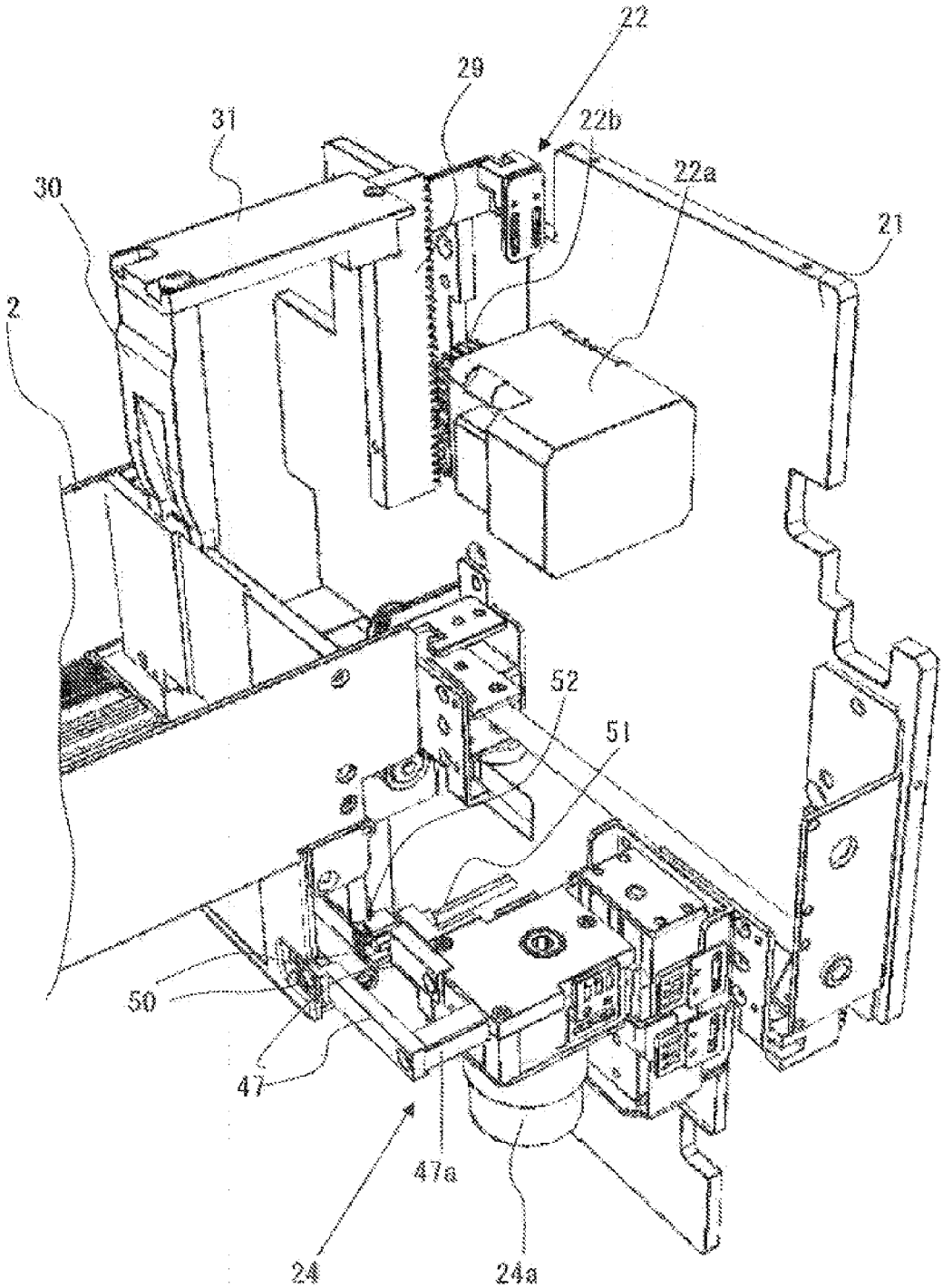
FIG. 10 is a perspective view showing, among the dispensing members of FIG. 1, the gripping member, first dispensing member, and second dispensing member attached to support plate.

The dispensing member 3, as shown in FIG. 8 through FIG. 10, is a support plate 21 provided with a first dispensing member 22, a second dispensing member 23, gripping member 24, cutting member 25 and a recovery member 26. The support plate 21, as shown in FIG. 2, is installed so as to be able to reciprocate on a horizontal rail 28 that can be raised/lowered with respect to a vertical rail 27 disposed at left and right on the front surface of the device body 1.

The first dispensing member 22, as shown in FIG. 10, is formed such that by engaging a rack 29 with a gear 22*b* provided in the rotating shaft of motor 22*a*, and rotating a motor 39 in forward/reverse direction, a pressing part 30 integrated with the rack 29 through an arm 31 can be raised/lowered.

Figure 11:
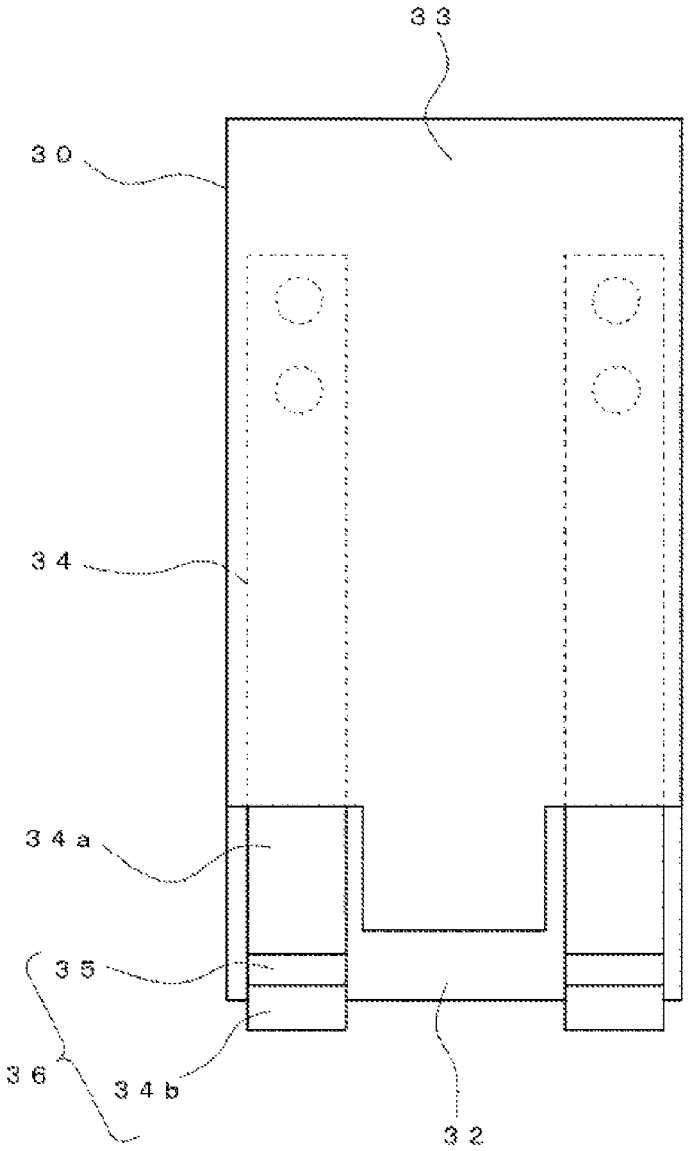
FIG. 11 is a front view depicting the pressing part of the second dispensing member of FIG. 10.

The upper end of the pressing part 30 is screwed to the tip of the arm 31, which is extending horizontally from the rack 29, and extends in the downward direction. Regarding the pressing part 30, as shown in FIG. 11 and FIG. 12, a rear part 33 is integrated on the back of the front plate 32. A gap is formed between the front plate 32 and the rear part 33, and at the upper area on both sides, an elastic piece 34 is fixed respectively. Regarding the rear part 33, the lower end positions of both sides are located higher than the lower end position of the front plate 32, and the lower end part of the elastic pieces 34 is exposed. The elastic piece 34 is configured from a linear section 34*a* that gradually slopes towards the rear part 33 in the lower direction from the fixed position, and a curved part 34*b* that curves towards the front plate 32 in the section that is exposed in the lower direction from the rear part 33. A lock piece 35 projects from the curved part 34*b*. The lock piece 35 may be formed by cutting a part of the elastic piece 34, or may be formed by integrally bonding a separate piece or the like. Thereupon, a curved part 34*b* and a lock piece 35 constitute the guide part 36. The guide part 36, as described later, is intended for reliably guiding the top edge portion of the blister package 4 and pushing it down regardless of the blister package 4 being curved or not. In particular, if the side edge of a blister package 4 is distorted so as to bend toward the elastic piece 34, the blister package 4 is biased by the elastic piece 34 and can be pushed down such that the distortion is suppressed. Also, it is preferable that the projection dimension of the lock piece 35 from the curved part 34*b* be almost same as the thickness of the sheet section of the blister package 4. With this, if a blister package 4 that is to be pushed down becomes curved as described above and approaches the adjacent next blister package 4, the lock piece 35 will not interfere with this blister package 4. Thus, according to the configuration of the above-mentioned pressing part 30, the push-down operation of a blister package 4 can be smoothly performed. Furthermore, although two elastic pieces 34 were provided, it is also possible to provide a configuration having only one elastic piece.

The second dispensing member 23, as shown in FIG. 8, is comprised of an electromagnet part (not shown) and a drive mechanism 37.

The electromagnet part is excited through energization, and intended to attract the magnetic part of cassette 2 in the advance position and to draw out the cassette 2 from the cassette mounting part 8 to the medicine retrieving position by retreating.

The drive mechanism 37 is configured such that the driving force of a motor 39 provided in mounting plate 38 having a substantially L-shaped cross section is transmitted to a rotating pin 43 through a gear, and can slide in the width direction according to the size of the cassette 2. Here, corresponding to three types of cassettes 2 of different sizes, it can be positioned at three guide positions and one retracted position.

Followings are the details of the drive mechanism 37. That is, a drive gear 40 is provided in the rotating shaft of the motor 39, an intermediate gear 41 meshes with the drive gear 40, and a driven gear 42 meshes with this intermediate gear 41. A driven plate 44 including a turning pin 43 is integrated with an end of the driven gear 42. The end section of the turning pin 43 can be engaged/disengaged with the operation hole 15*a* formed in the bearing part 15 of the opening/closing door 10. Also, a guide pin 46 that can be positioned in a guide hole 9*e* of the cassette body 9 is integrated with the mounting plate 38. The tip of the guide pin 46 is formed in a cone-shape so as to facilitate easy penetration into the guide hole 9*e*. If the motor 39 is rotated in forward/reverse direction in a state wherein the guide pin 46 is positioned in the guide hole 9*e*, and the turning pin 43 is positioned inside the operation hole 45, the driven plate 44, i.e. the turning pin 43, will rotate via the gear. With this, the opening/closing door 10, positioned by the guide pin 46 and with the spindle 10*a* as center, will rotate respectively to the normal dispensing position and the fraction dispensing position. It is further preferable to provide a torque limiter etc. in any of the power transmission path from motor 39 up to driven plate 44 (to the rotating shaft of the driven gear 42, for example). With this, when rotating the opening/closing door 10 to closed position by the drive mechanism 37, unnecessary load is not applied to the cassette body 9, and damage can be prevented.

Figure 7:
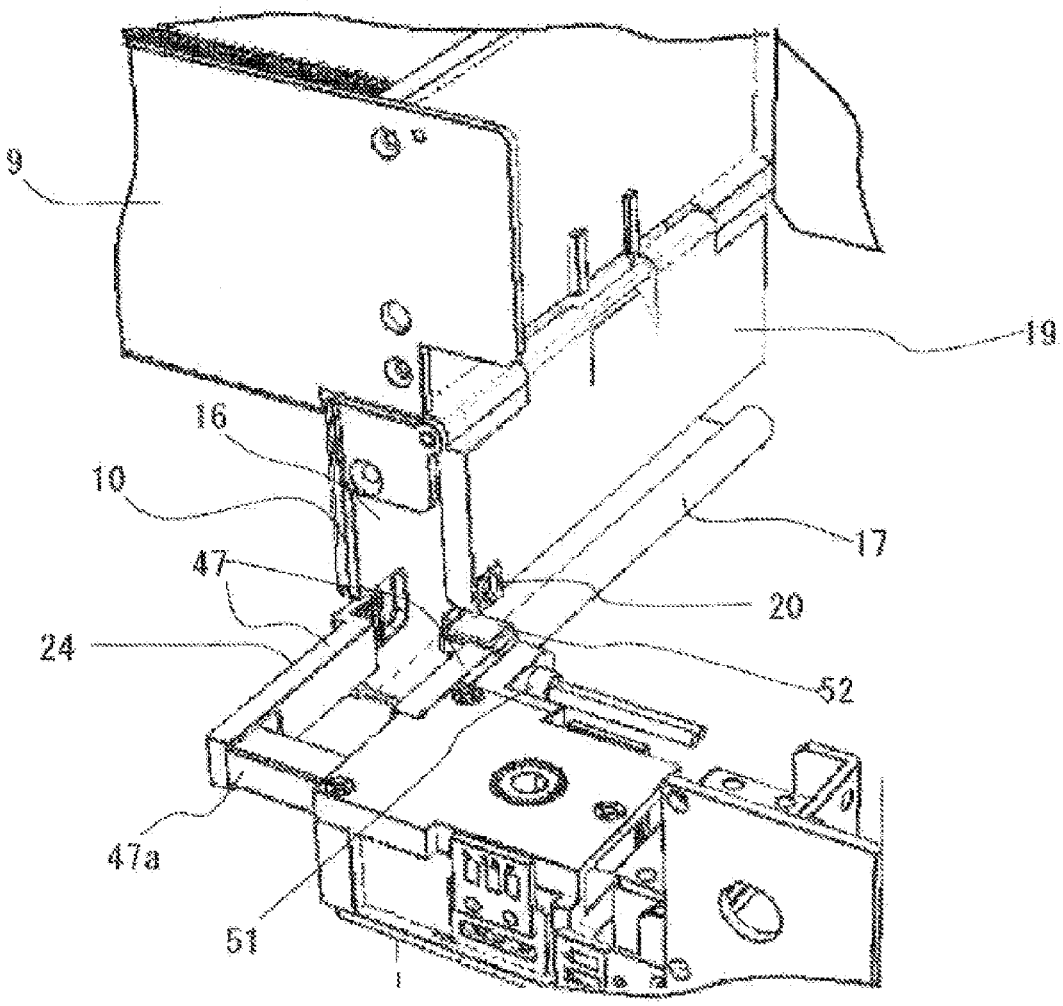
FIG. 7 is a partial perspective view of an opening/closing door and gripping member of FIG. 4.

The gripping member 24, as shown in FIG. 7 and FIG. 10, consists of a pair of gripping pieces 47. The gripping piece 47 is installed in the front part of the support plate 21 such that it can reciprocate in the horizontal direction. Thereupon, by conveying the driving power of motor 24*a*, via a pinion (not shown) provided in its rotating shaft, to a rack (not shown) formed on opposite faces of an arm 47*a* extending from each gripping piece 47 (one is not shown), opening/closing is done. Also, one end (free end) of each gripping piece 47 is bent in the form of a crank to form mutually facing gripping parts 50. A through-hole is formed in each gripping part 50 respectively, and with the help of a light sensor 51 provided in one of the gripping pieces 47, it is possible to detect through the through-hole as to whether a blister package 4 is being held or not. In addition, a magnet 52 (here, a neodymium magnet is used) is provided to one of the gripping pieces 47. This magnet 52 is intended for attracting an attracted part 20 provided in the holding piece 19 of the opening/closing door 10, and rotating this holding piece 19 to separate it from the front surface portion 16.

In the cutting member 25, as shown in FIG. 9, a pair of cutting blades 55 (see FIG. 14) that can be contacted/separated across a gap 54 is provided in the fulcrum 53. One end of the fulcrum 53 is fixed to a fan-shaped rotating plate 56 that functions as a position adjustment member. A gear is formed in the outer peripheral edge of the rotating plate 56. This gear meshes with a gear provided in the rotating shaft of motor 56*a*. Thereupon, by driving the motor 56*a*, the rotating plate 56 is rotated forward or backward via the gear. With this, the cutting blade 55 is rotated together with the rotating plate 56, and the cutting position of a blister package 4 held by the gripping member 24 is changed. Here, the cutting member 25 is used by positioning it in two positions, namely, horizontal position (FIG. 9) and vertical position. Further, the cutting member 25 is provided with a lifting mechanism, which is not shown, and with which the cutting position of the cutting blade 55 can be adjusted. With this, blister packages 4 having multiple rows can be cut by a fraction of minimum one tablet unit. Moreover, it is preferable that a pressing member (not shown) for preventing misalignment of a blister package 4 inserted in the gap of fulcrum 53 is provided to prevent a misalignment of the blister package 4 (flying, jumping etc.) due to impact when cut.

The recovery member 26, as shown in FIG. 9, is provided with a guiding path 57 and a recovery container 58. The guiding path 57 is configured from a straight part 57*a* and an inclined part 57*b*. A blister package 4 falling from the outlet 13 of a cassette 2 will pass through the straight part 52*a*, and a fraction of a blister package 4 that was cut by the cutting member 25 will pass through the inclined part 57*b* and join in the straight part 52*a*. The recovery container 58 has three storage compartments (not shown), and blister packages 4 fed via the guiding path 57 are conveyed into each section provided in a tray (not shown) carried by the conveying device 7.

2. Operation

Figure 16:
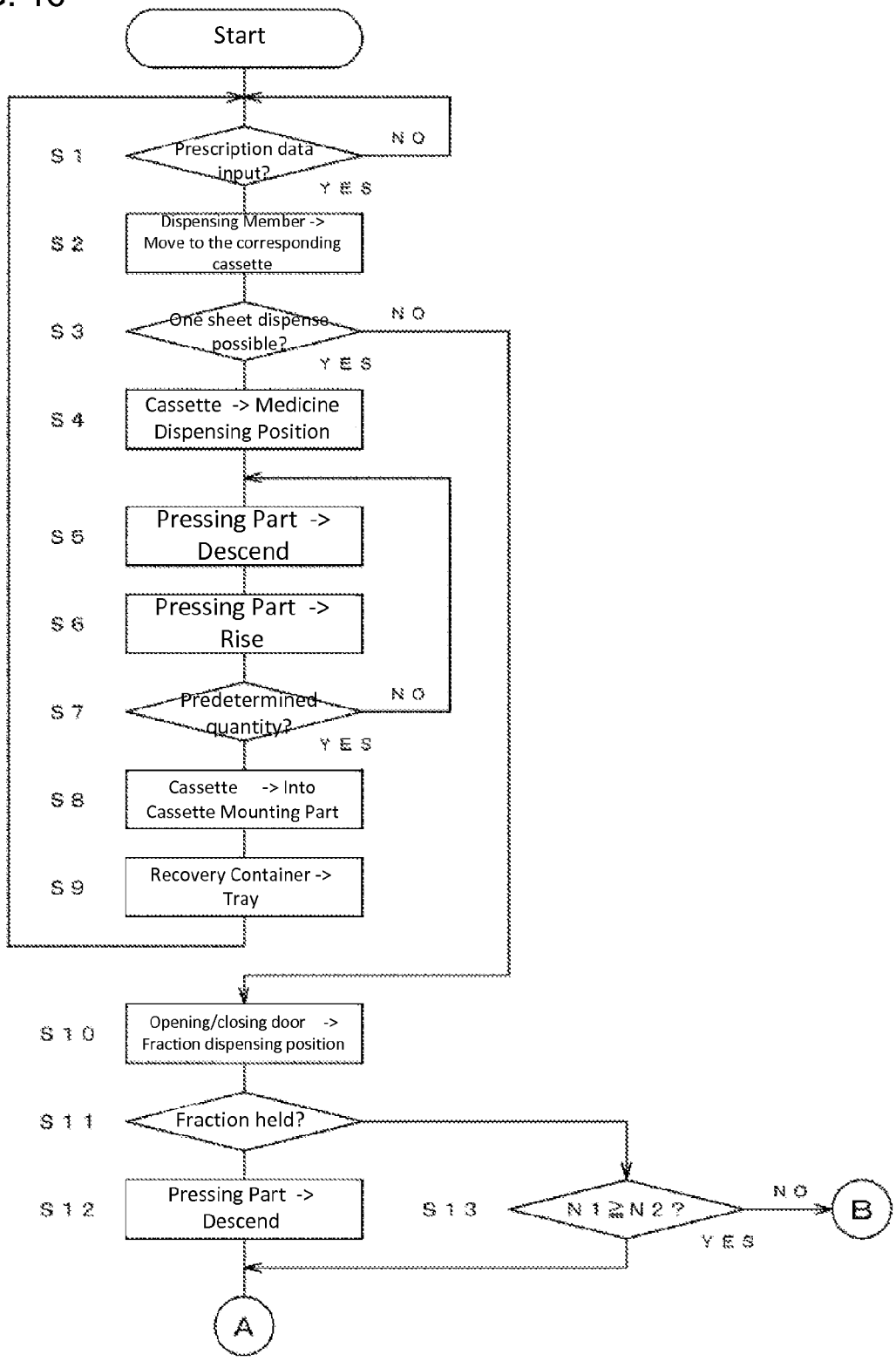
FIG. 16 is a flow chart showing the dispensing process of a medicine by a control member of the medicine dispensing device according to the present embodiment.
Figure 17:
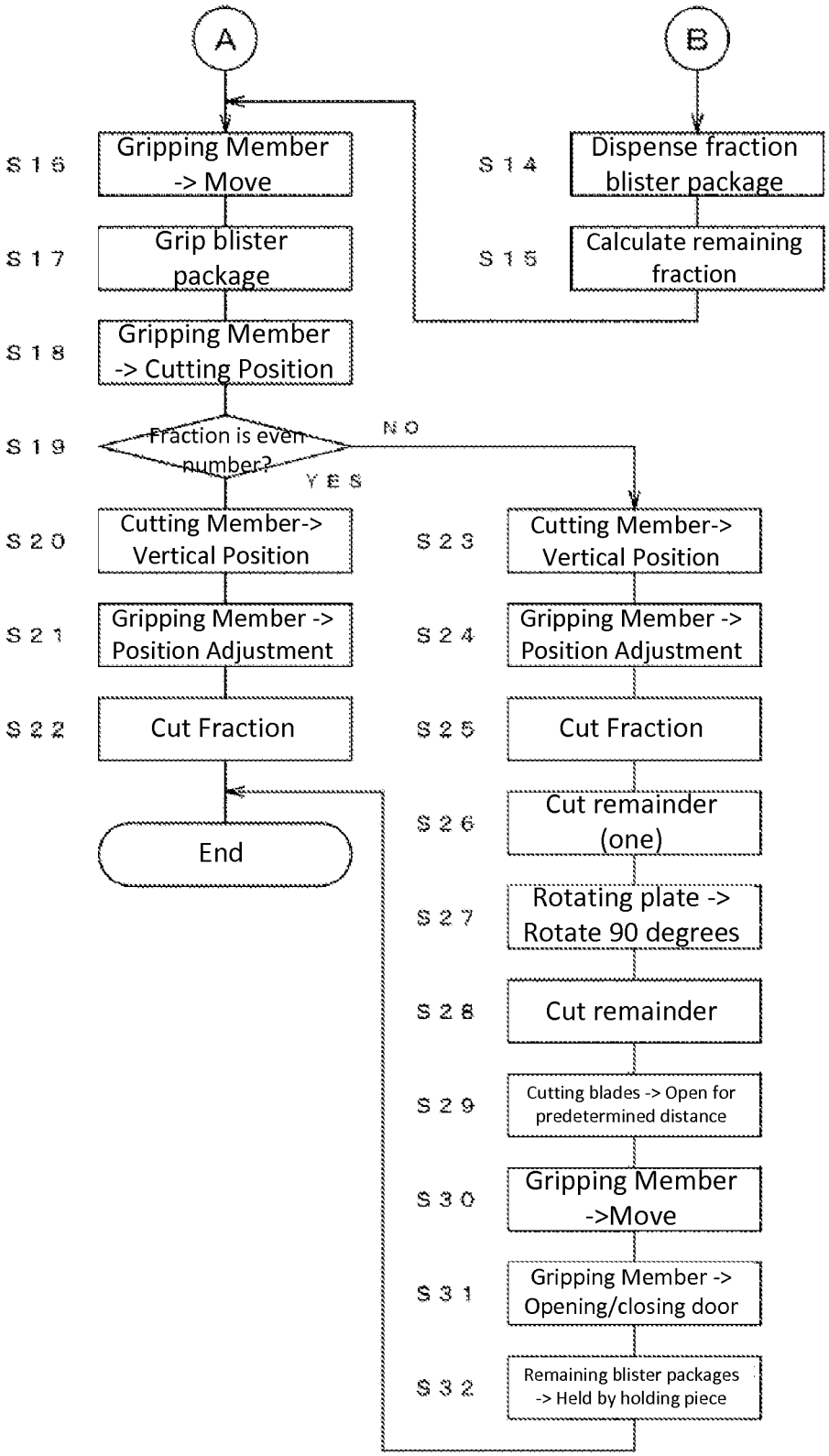
FIG. 17 is a flow chart showing the dispensing process of a medicine by a control member of the medicine dispensing device according to the present embodiment.

Next, the operation of a medicine dispensing device of the configuration described above will be explained with reference to the flowcharts in FIG. 16 and FIG. 17.

When prescription data is input from a host computer (not illustrated) etc. (step S1), based on the input prescription data, the dispensing member 3 is moved to a cassette 2 wherein the blister packages 4 of the corresponding medicine have been housed (step S2). Then, it is determined whether a blister package 4 is to be dispensed as one whole sheet or not (step S3). This can be determined based on whether the quantity of a medicine contained in the prescription data is more than the quantity of the medicine contained in one sheet of the blister package 4 or not. Here, how many strips of the blister packages 4 have to be dispensed is calculated. This calculation can be done based on how many times the quantity of the former would be of the quantity of the latter. When dispensing several strips of the blister packages 4, the quantity left over as fraction will be dispensed in processes after the step S10, which are described later.

When one full sheet of a blister package 4 is dispensed (step S3: YES), the support plate 21 is moved, and the electromagnet part is excited. With this, the magnetic part of the cassette 2 is being attracted, and therefore, the support plate 21 is retracted, and the cassette 2 is positioned in the medicine dispensing position (step S4). In this state, as shown in FIG. 12 (*a*), it will assume a state wherein a blister package 4 positioned at top can be pressed down by the pressing part 30 of the dispensing member 3. Then, the motor 22*a* is driven to move the pressing part 30 downward via gear 22*b* and rack 29 (step S5), and then, as shown in FIG. 12 (*b*), the curved part 34*b* of elastic piece 34 of the pressing part 30 will come in contact with the upper edge of the blister package 4. Thereupon, by contacting the straight part 34*a* of the elastic piece 34 with the rear part 33 of the pressing part 30 and limiting the bending towards rear surface, it is possible to ensure the pressing down operation of the blister package 4. Further, as shown FIG. 12(*c*), when the pressing part 30 is moved downward, the elastic piece 34 will be elastically deformed, and the upper edge of the blister package 4 will be guided by the guide part 36. With this, only the blister package 4 positioned at the top will be smoothly dispensed from cassette 2 via the outlet 13. Also, when a blister package 4 positioned at top is dispensed from the outlet 13, the next blister package 4 biased by a constant force spring will contact the rear part 33, and there will be no interference with the elastic piece 34. Therefore, by smoothly moving the pressing part 30 upwards, it can be smoothly returned to the initial state shown in FIG. 12(*a*).

Figure 13:
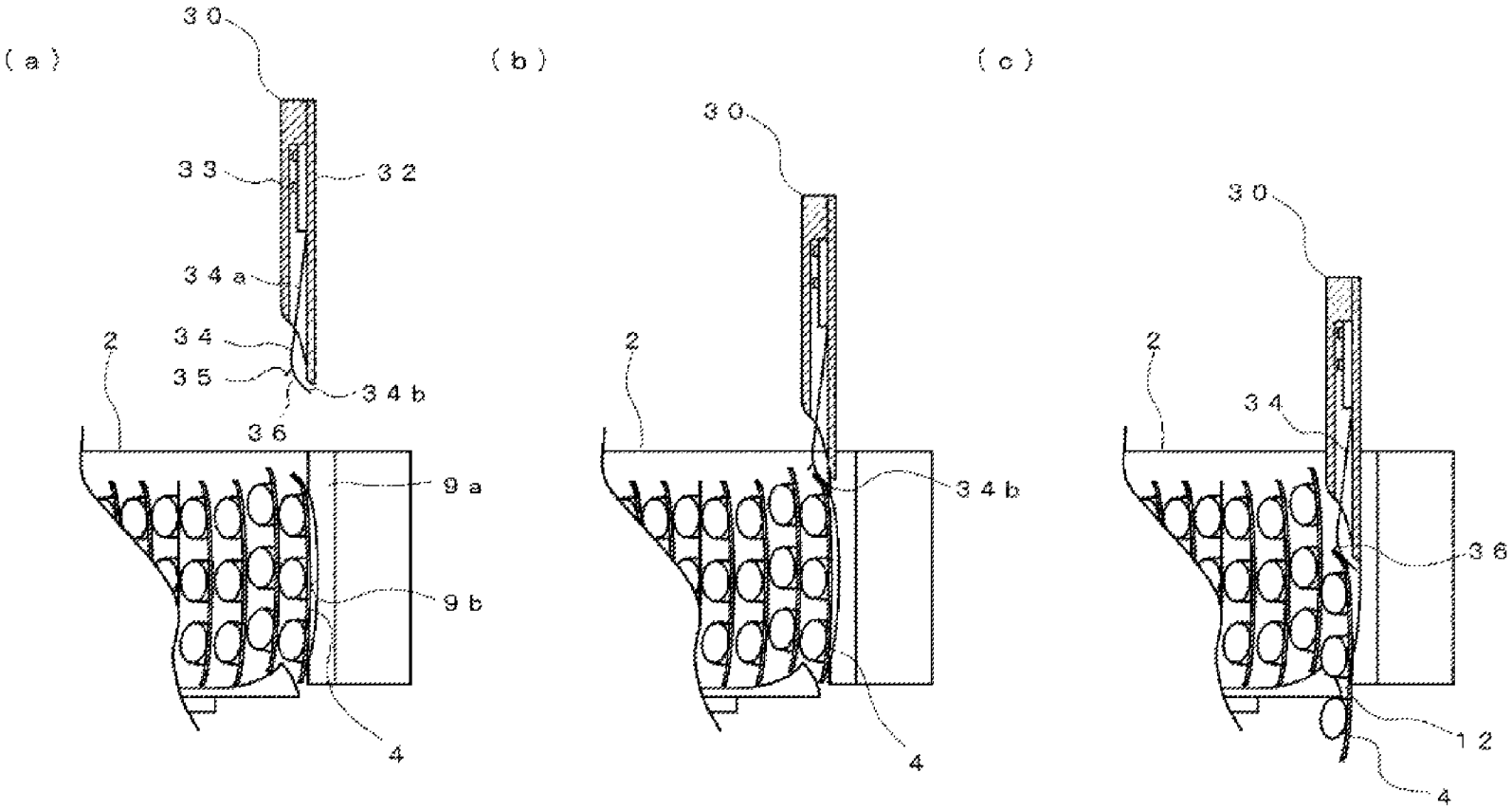
FIG. 13 is a schematic side view showing a dispensing operation of dispensing a bent blister package for a fraction from the cassette by the pressing part of FIG. 11.

Here, several blister packages 4 are often bundled in a rubber band etc., and delivered. Due to this, a blister package 4 set inside cassette body 9 may curve in a direction transverse to the perpendicular side. Regarding the pressing part 30, as described earlier, a guide part 36 is formed at the lower end of the elastic piece 34. Therefore, even if a blister package 4 to be pressed down is assumed to be curved, as shown in FIG. 13(*a*) for example, by moving the pressing part 30 in the lower direction, the upper edge of the top blister package 4 can be always guided by the guide part 36, as shown in FIGS.

13 (*b*) to (*c*). Moreover, by the elastic force of the elastic piece 34, the blister package 4 is biased in the direction to correct a curved shape. Therefore, even if a blister package 4 is curved, it can be smoothly dispensed from the cassette 2 through the outlet 13. The dispensed blister package 4 is collected into the recovery container 58 through the guiding path 57. The pressing part 30 is temporarily lifted in order to press down the next blister package 4 (step S6).

Then, it is determined whether or not the number of the blister packages 4 dispensed as one whole sheet is same as the predetermined number calculated based on the prescription data (step S7). If it is not same as the predetermined number, the process is returned to step S5 to repeat the push-down operation of lowering the pressing part 30 (step S5) and the operation of lifting (step S6). If it is same as the predetermined number, dispensing of the blister packages 4 is deemed to have been completed, and the cassette 2 is housed in the cassette mounting part 8 by moving the electromagnet part forward (step S8). Then, the recovery container 58 (dispensing member 3) is moved to the tray, which is not shown (step S9).

When a blister package 4 is dispensed in fractions (step S3: NO), the opening/closing door 10 is rotated 180 degree by the turning pin 43 and positioned at the fraction dispensing position (step S10). Then, it is determined whether or not a fraction of a blister package 4 has been held in the opening/closing door 10 (fraction held?) (step S11).

If a fraction of a blister package 4 is not held in the opening/closing door 10 (step S11: YES), a blister package 4 positioned at top is pressed down by the pressing part 30 in the same way as above, and discharged through the outlet 13 (step S12). The discharged blister package 4, with the help of the holding piece 19 that is biased towards the front plate 32 by a coil spring, is sandwiched between the front plate 32 and the holding piece 19.

If fractions of a blister package 4 are held in the opening/closing door 10, whether the quantity of the medicine N1 is more than the desired quantity N2 to be dispensed as per prescription data (Step S13). If N1≥N2, then steps S16 to S30 (described later) are executed. If N1<N2, after gripping a fraction of the blister package 4 with the gripping member 24 and dispensing it to the recovery container 58 (step S14), the remaining fraction part is calculated (step S15), and this remaining fraction is subjected to steps S16-S30, which are described later.

When dispensing a fraction, the gripping member 24 is brought closer to the opening/closing door 10 (step S16). Subsequently, by separating the gripping pieces 47 and moving the blister package 4 to a position where it can be gripped, the magnet 52 provided near the gripping member 24 will attract the attracted part 20 provided in the holding piece 19, and as shown in FIG. 7, the holding piece 19 is rotated in a direction away from the front surface portion 16. The blister package 4 will lose the holding by the holding piece 19, and drop till its lower edge touches the guide reception part 17. With this, the blister package 4 can be always positioned in the same position in a vertical direction with respect to the reference surface 17*a* of the guide reception part 17 of the opening/closing door 10. In other words, a blister package 4 can always be positioned immediately before the blister package 4 is gripped by the gripping member 24. However, there is no particular restriction on when to rotate the holding piece 19 by magnet 52 as whether it should occur after cutting by the cutting member 25, etc. Moreover, because the blister package 4 is discharged vertically in the lower direction by the pressing part 30 via the outlet 13 of the cassette 2, there is hardly any misalignment in the horizontal direction.

Thereupon, the gripping member 24 is driven, and through the notch 18 formed in the guide reception part 17, the edge section of the blister package 4 is gripped with the gripping piece 47 (step S17). Here, based on the detection signal in the light sensor 51, the edge section of the blister package 4 is detected, and whether the blister package 4 is surely held by the gripping piece 47 is checked. Then, the gripping member 24 is moved horizontally and positioned at the cutting position of the cutting member 25 (step S18). In the cutting member 25, the rotation position is changed depending on the fraction of the blister package 4.

In case the pockets of a blister package 4 are even number of columns (2 columns or 4 columns), whether the fraction is even number or not is determined (step S19). If the fraction is even number (step S19: YES), the cutting member 25 is vertically positioned by rotating it 90 degree (step S20), and by adjusting the position of the gripping member 24, the part to be cut off is positioned to be a desired quantity (step S21). With this, when a blister package 4 is cut laterally by the cutting member 25 (step S22), only the desired fraction can be recovered to the recovery container 58 through the guiding path 57.

If the fraction is an odd number (step S15: NO), after the blister package 4 is cut in the lateral direction as described above (steps S23-S25), one remaining part is cut from the remaining blister package 4. In this case, after cutting the remaining blister package 4 laterally by only half from the edge in the width direction (step S26), the rotating plate 56 is rotated 90 degree to be in horizontal position (step S27), and only half may be cut in the vertical direction (step S28).

Figure 14:
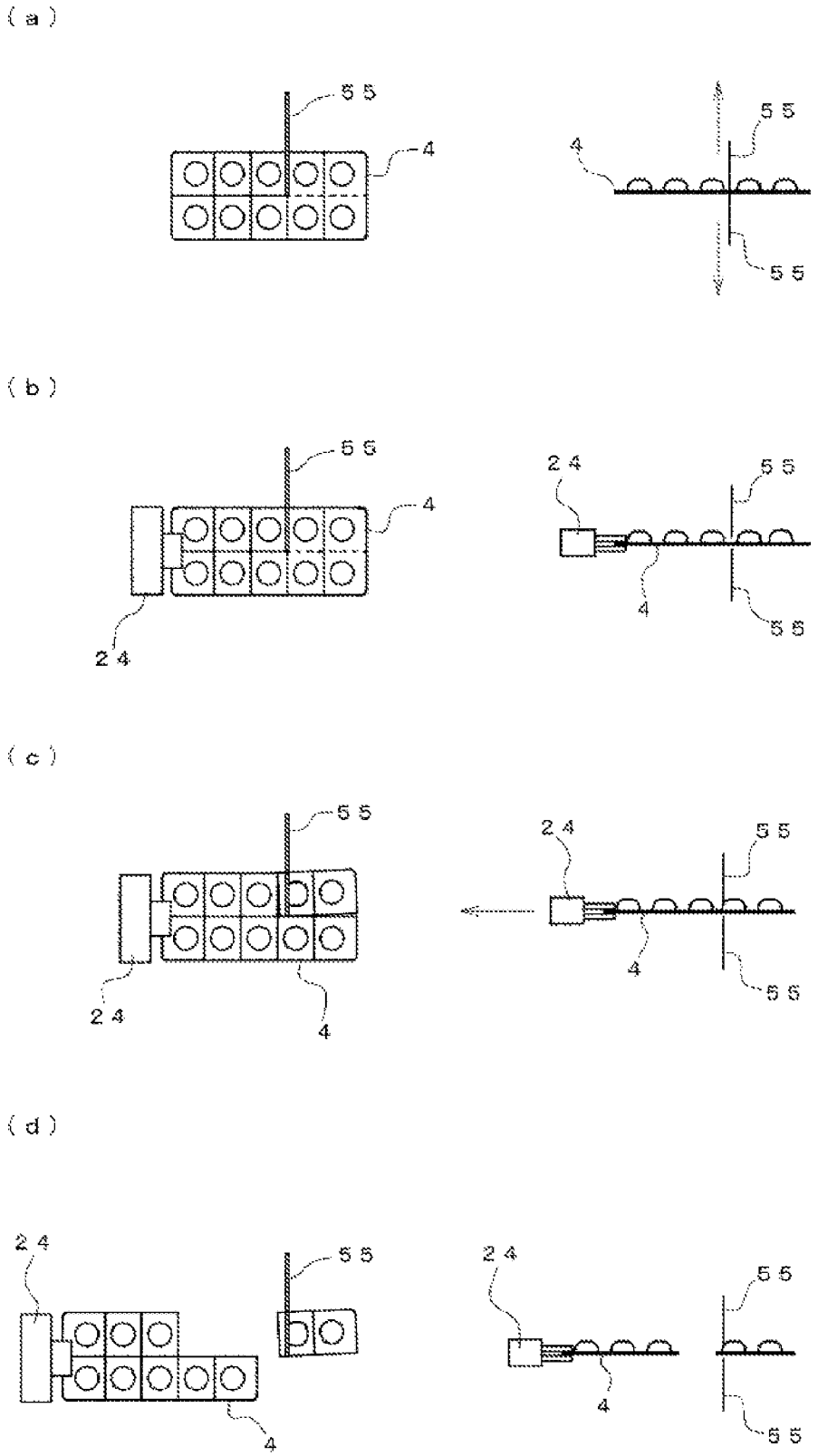
FIG. 14 is an explanatory diagram showing an example of a method of cutting a fraction by the cutting member shown in FIG. 9.

Also, thus, when cutting a blister package 4 half in lateral direction and vertical direction, it may be expected that the package is not separated well in the boundary section of the cutting sites. Therefore, after cutting in the lateral direction as shown in FIG. 14(*a*), the cutting blades 55 are temporarily opened at a predetermined distance as shown in FIG. 14(*b*) (step S29). Regarding the distance of opening here, the gap between the cutting blades 55 shall be wider than the thickness of the sheet part of a blister package 4, but not to exceed the thickness of the entire body including the pockets. Then, as shown in FIGS. 14 (*c*) and (*d*), by moving the gripping member 24 in the horizontal direction (step S30), even if it is not well separated in the boundary section of the cutting sites, it is possible to detach it forcibly. Moreover, in FIG. 14, although a case of cutting two medicines was illustrated, the method is same for one medicine.

Moreover, if the pockets in a blister package 4 are odd number of columns (three columns), depending on if the fraction is even number or odd number, a process reverse to the above may be carried out.

The remaining blister package 4, following cutting of a fraction as above, is transported to the guide reception part 17 of the opening/closing door 10 by moving the gripping member 24 (step S31). Then, by releasing the gripping by the gripping member 24, the remaining blister package 4 is held by the holding piece 19 provided in the guide reception part 17 (step S32). In this case, same as the above, a gap is formed by separating the holding piece 19 of the opening/closing door 10 from the front surface portion 16 by the action of the magnet 52. Therefore, just by moving the gripping member 24, the blister package 4 can be smoothly positioned between the front surface portion 16 and the holding piece 19. Therefore, when gripping by the gripping member 24 is released and this gripping member 24 is moved, the holding piece 19 is rotated because of biasing by the coil spring, and the blister package 4 can be sandwiched between the holding piece 19 and the front surface portion 16. Also, if the blister package 4 is sandwiched, the support position by the holding piece 19 may be stored in memory as a coordinate data along with the remaining quantity (number of pockets), and the gripping member 24 may be moved based on this data to dispense the remaining blister package 4 when dispensing the next blister package 4. When the remaining blister package 4 held in the guide reception part 17 is exhausted, a new blister package 4 may be discharged from the cassette 2 to the guide reception part 17, and cut in the same way as the above.

Moreover, the pushing direction by the pressing part 30 is not restricted to vertical direction, and horizontal direction is also possible. Further, the pushing direction of a blister package 4 is not restricted to transverse direction, and length direction is also possible. When pushing it in the length direction, the edge section of a blister package 4 (plate-like portion that can be detached from the pocket part) may be positioned in the lower direction. When pushing a blister package 4 in the length direction, by rotating the storage direction of the blister package 4 by 90 degree and directing its length direction toward the vertical direction, the short side of the blister package 4 may be pressed down by the pressing part 30, or the pressing part 30 may be rotated by 90 degree to push the blister package 4 in the horizontal direction. According to this, the blister package 4 will not be off balance unlike when pressing both ends of the long side of a blister package 4, and a blister package 4 can be smoothly discharged.

Further, when cutting a fraction from a blister package 4, a process was used wherein the blister package 4 is cut in the lateral direction in case of even number, and in case of odd number, an even number was cut in the lateral direction followed by cutting the remaining one medicine, but it is not restricted to such a cutting method. For example, when cutting two medicines from a two-column blister package 4, it is also possible to cut two medicines from one column as shown in FIG. 14.

Figure 18:
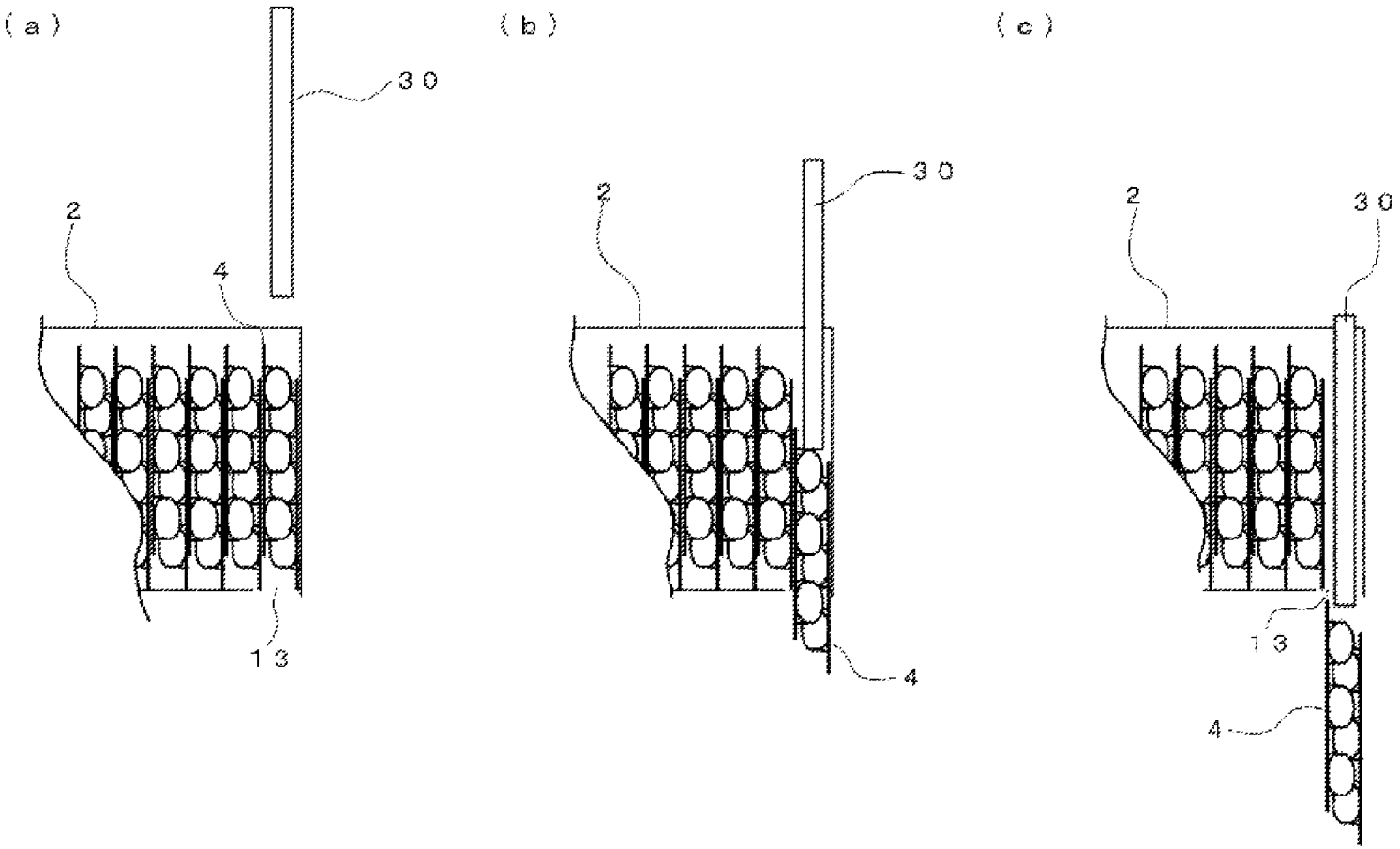
FIG. 18 is a schematic side view showing a dispensing operation of dispensing two blister packages at once from a cassette by the pressing part of FIG. 11.

Further, it is also possible to provide a configuration of dispensing two sheets of a blister package 4 simultaneously as shown in FIG. 18. In this case, it is preferable that the protruding sides of the tablet accommodating part of the blister package 4 are in mutual contact. In particular, by shifting the position of the protruding sections (the pocket part) between the blister packages 4, it becomes easier to transport two blister packages 4 integrally. Usually, when delivered by a pharmaceutical manufacturer, two blister packages 4 are supplied in the box in such a tied state. Thus, the blister packages 4 can be set as is directly after retrieving them from a delivered box.

When setting blister packages 4 in such a state, the pressing part 30 may simply be configured such that the bottom surface thereof can press down two blister packages 4. In FIG. 18, by making the pressing part 30 a flat plate, its bottom surface can press down pockets which are overlapped with positional misalignment. Moreover, the gap of the outlet 13 of the cassette 2 is set to a value such that two blister packages 4 can pass through. By this, when the pressing part 30 is moved downwardly from the state shown in FIG. 18 (*a*), the two blister packages 4 are pressed down by the bottom surface and discharged from the outlet 13 as shown in FIG. 18 (*b*). Then, in a state where two blister packages 4 are discharged completely through the outlet 13 as shown in FIG. 18 (*c*), among the blister packages 4 that are biased towards the front side in the cassette 2, the next blister package 4 positioned at the top will contact the inner surface of the pressing part 30. Accordingly, it is preferable to provide a configuration to prevent a blister package 4 and the pressing part 30 moving together in the upward direction by minimizing the area of contact with the blister package 4 by providing a protrusion or ridge in the inner surface of the pressing part 30. In addition, it is preferable to form a ceiling in the upper surface of the cassette 2 to prevent the next blister package 4 from moving upward.

When using a cassette 2 having a configuration to dispense a blister package 4 by the pressing part 30 as shown in FIG. 18, it is possible to dispense only fractions (including only one sheet) from the aforementioned cassette 2 shown in FIG. 4 etc. That is, the same type of blister packages 4 are loaded in these two types of cassettes 2, and two sheets each may be rapidly dispensed from the cassette 2 of the type shown in FIG. 18, and only fractions (including only one sheet) may be dispensed from the cassette 2 shown in FIG. 4, etc. With this, a significant improvement in the working efficiency can be achieved.

Further, in the above-mentioned embodiment, the holding piece 19 was rotated by the attraction force of the magnet 52 provided in the gripping member 24 as an action part without an actual contact, but it is also possible to provide a configuration in which, instead of providing the magnet 52, a lock piece or the like contacts the holding piece 19 to directly rotate the holding piece 19. Further, although a plate-shaped holding piece 19 was used as a holding part, any form can be used as long as it is able to hold the blister package 4.

3. Other Embodiments

The present invention is not limited to the configuration described in the above embodiment, and various modifications are possible within the scope of technical matters that are described in the claims.

3-1. Embodiment 2

In the embodiment mentioned above, the position of the cutting member 25 was changed with respect to a blister package 4 gripped in the gripping member 24 by rotating the rotating plate 56, but it is also possible to change the position of a blister package 4 gripped in the gripping member 24 with respect to the cutting member 25 by rotating the gripping member 24, or rotating both the cutting member 25 and the gripping member 24.

3-2. Embodiment 3

The pressing part 30 may also have the following configuration.

Namely, instead of providing an elastic piece 34, it is also possible to have a configuration comprised of a plate material and a biasing member for biasing this plate material. It is preferable that the plate material be made of a resin, but it may also be made from a metal etc. As the biasing member, a variety of materials such as urethane rubber, coil spring etc. can be used. By configuring with a plate material and biasing member, the durability can be improved compared to the case of using a plate spring.

3-3. Embodiment 4

Figure 19:
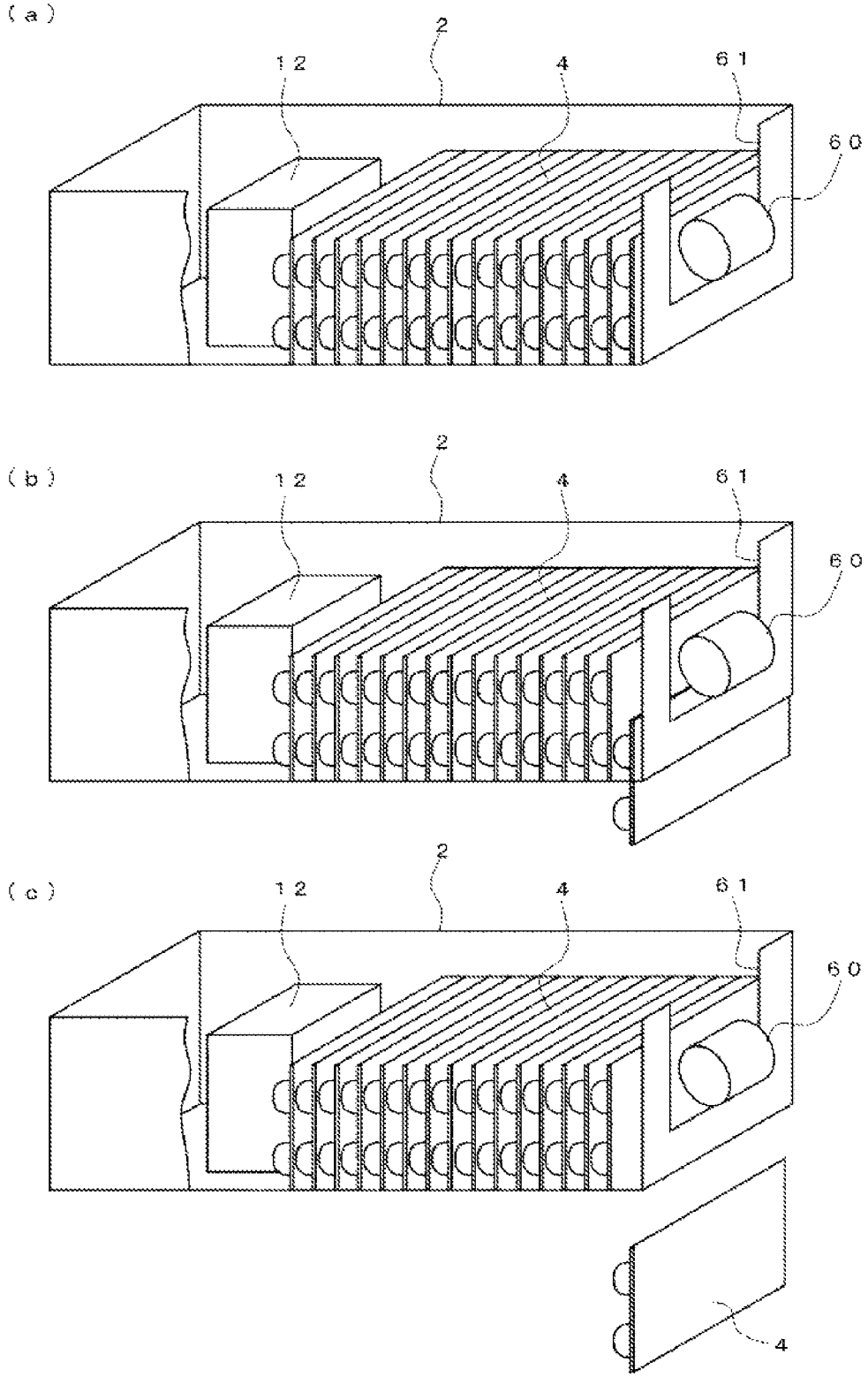
FIG. 19 is a schematic explanatory diagram showing dispensing by a dispensing member of the medicine dispensing device according to another embodiment.

The dispensing member 3 may also be configured with a roller part instead of the holding piece 19 formed by a plate spring. For example, as shown in FIG. 19, it is possible to integrate a rubber roller in the circumference of the rotating shaft as a roller member 60 so that it can rotate. Also, notch 61 (or an opening) is formed in the vertical direction in the front plate 9*a* of the cassette body 9, and through this notch 61, the roller member 60 is pushed against the blister package 4 that is positioned at top. Thereupon, by driving and rotating the roller member 60, this blister package 4 is dispensed in the lower direction through the outlet 13.

3-4. Embodiment 5

A fraction of the blister package 4 was made to be held in the guide reception part 17 in a state where opening/closing door 10 is rotated by 180 degree, but it is also possible to provide, without need to rotate the opening/closing door 10, a storage part that can store a fraction of the blister package 4. Blister packages 4 can be conveyed to the storage part by the gripping member 24.

EXPLANATION OF NUMBERS

1 . . . Device body
2 . . . Cassette (storage container)
3 . . . Dispensing member
4 . . . Blister package
5 . . . Frame
6 . . . Exterior panel
7 . . . Conveying device
8 . . . Cassette mounting section
9 . . . Cassette body
9*a* . . . Guide surface
9*b* . . . Curved surface
9*c* . . . Guide surface part
9*d* . . . Lock hole
9*e* . . . Guide hole
10 . . . Opening/closing door
11 . . . Guide groove
12 . . . Pushing member
13 . . . Outlet
14 . . . Recess
15 . . . Bearing part
16 . . . Front surface portion
17 . . . Guide reception part
18 . . . Notch portion
19 . . . Holding piece
20 . . . Attracted part
21 . . . Support plate
22 . . . First dispensing member
23 . . . Second dispensing member
24 . . . Gripping member
25 . . . Cutting member
26 . . . Recovery member
27 . . . Vertical rail
28 . . . Horizontal rail
29 . . . Rack
30 . . . Pressing part
31 . . . Arm
32 . . . Front plate
33 . . . Rear part
34 . . . Elastic piece
35 . . . Lock piece
36 . . . Guide part
37 . . . Drive mechanism
38 . . . Mounting plate
39 . . . Motor
40 . . . Drive gear
41 . . . Intermediate gear
42 . . . Driven gear
43 . . . Rotating pin
44 . . . Driven plate
45 . . . Operation hole
46 . . . Guide pin
47 . . . Gripping piece
48 . . . Guide plate
49*a* . . . First curved surface
49*b* . . . Second curved surface
50 . . . Gripping part
51 . . . Light sensor
52 . . . Magnet
53 . . . Fulcrum
54 . . . Fixed blade
55 . . . Movable blade
56 . . . Rotating plate
57 . . . Guiding path
58 . . . Recovery container

The invention claimed is:

1. A medicine dispensing device comprising:
a device body;
a storage container that accommodates in a stacked state a plurality of blister packages in which medicines are separately packed, the storage container being attached to the device body such that a direction in which the blister packages are stacked is horizontal or approximately horizontal direction;
a dispensing member movably provided at the device body, the dispensing member moving up to the storage container and dispensing the accommodated blister package;
a gripping member that grips and transports the blister package dispensed by the dispensing member; and
a cutting member that cuts a fraction out of the blister package that is gripped and transported by the gripping member,
wherein the storage container includes:
an outlet formed in a bottom surface at one end side for taking out the blister package;
a biasing member that biases the accommodated blister package towards the outlet side; and
an opening/closing door that is disposed at an outer end surface at the outlet side,
wherein the opening/closing door includes:
a guide reception part that guides the blister package that is dispensed from the outlet of the storage container;
a holding part that is capable of moving between a holding position for holding the blister package with the guide reception part and a releasing position for releasing the blister package; and
a biasing part that biases the holding part towards the holding position,
wherein the guide reception part has a reference surface with which a lower edge part of the blister package can come into contact so as to position the blister package when the holding part is moved to the releasing position, and
wherein the gripping member has an action part that can move the holding part from the holding position to the releasing position against a biasing force of the biasing part.

2. The medicine dispensing device according to claim 1, wherein the gripping member includes a pair of holding pieces that is openable and closable, and a sensor that is capable of detecting the blister package.

3. The medicine dispensing device according to claim 1, wherein the opening/closing door can be positioned at a normal dispensing position and at a fraction dispensing position, the normal dispensing position allowing a dispensing operation of the blister package by the dispensing member, and the fraction dispensing position allowing a dispensing operation of the blister package by the dispensing member and enabling the holding part to hold the dispensed blister package, and wherein the gripping member can grip at the fraction dispensing position the blister package that is held by the holding part of the opening/closing door and transport the blister package to the cutting member, and the remaining blister package after the fraction is cut by the cutting member is transported and held by the holding part of the opening/closing door.

4. The medicine dispensing device according to claim 1 further comprises a control member for positioning the lower edge part of the blister package by the weight of the blister package with respect to the reference surface by driving and controlling the gripping member and rotating the holding part once to the releasing position by the action part when holding the blister package at the opening/closing door.

5. The medicine dispensing device according to claim 1, wherein the holding part of the opening/closing door includes a magnetic material, and wherein the action part of the gripping member includes a magnet that can attract the holding part.

6. The medicine dispensing device according to claim 5, wherein the gripping member includes a magnet at one holding piece, and when the holding piece is positioned at the releasing position, the holding part of the opening/closing door is attracted and a holding state of the blister package is released.

* * * * *